US009617672B2

(12) United States Patent
Lonati et al.

(10) Patent No.: US 9,617,672 B2
(45) Date of Patent: Apr. 11, 2017

(54) METHOD FOR PERFORMING THE AUTOMATED CLOSURE OF AN AXIAL END OF A TUBULAR MANUFACTURE AND FOR UNLOADING IT INSIDE OUT AND APPARATUS FOR PERFORMING THE METHOD

(71) Applicants: Lonati S.P.A., Brescia (IT); Francesco Lonati, San Felice del Benaco (IT); Matteo Lonati, Brescia (IT)

(72) Inventors: Ettore Lonati, Botticino (IT); Fausto Lonati, Brescia (IT); Tiberio Lonati, Brescia (IT)

(73) Assignee: LONATI S.P.A., Brescia (IT)

( * ) Notice: Subject to any disclaimer, the term of this patent is extended or adjusted under 35 U.S.C. 154(b) by 0 days.

(21) Appl. No.: 14/767,543

(22) PCT Filed: Feb. 26, 2014

(86) PCT No.: PCT/EP2014/053720

§ 371 (c)(1),
(2) Date: Aug. 12, 2015

(87) PCT Pub. No.: WO2014/131794

PCT Pub. Date: Sep. 4, 2014

(65) Prior Publication Data

US 2016/0053421 A1 Feb. 25, 2016

(30) Foreign Application Priority Data

Feb. 28, 2013 (IT) ..... MI2013A0296

(51) Int. Cl.

| | |
|---|---|
| ***D05B 35/00*** | (2006.01) |
| ***D05B 23/00*** | (2006.01) |
| ***D04B 15/92*** | (2006.01) |

(52) U.S. Cl.
CPC ..... *D05B 35/00* (2013.01); *D04B 15/92* (2013.01); *D05B 23/00* (2013.01); *D05B 23/009* (2013.01)

(58) Field of Classification Search
CPC .. D05B 23/006; D05B 23/007; D05B 23/009; D05B 7/00; D05B 35/00; D05B 35/02;
(Continued)

(56) References Cited

U.S. PATENT DOCUMENTS 5,349,913 A 9/1994 Schramayr et al.
6,164,091 A * 12/2000 Frullini et al.
(Continued)

FOREIGN PATENT DOCUMENTS

CN 1961110 5/2007
CN 101243223 8/2008
(Continued)

OTHER PUBLICATIONS

PCT/US2014/053720 International Search Report dated Mar. 25, 2014.
(Continued)

*Primary Examiner* — Ismael Izaguirre
(74) *Attorney, Agent, or Firm* — Husch Blackwell LLP

(57) ABSTRACT

A method for performing the automated closure of an axial end of a tubular manufacture and for unloading it inside out, comprising a step of positioning the manufacture right way out at a sewing or linking station, arranged so that its axis is substantially vertical and so that it hangs, by means of a first axial end to be closed by sewing or linking, from an annular handling device; then a step of turning the manufacture inside out is performed; a step of closing the first axial end of the manufacture by sewing or linking is then performed; then a step of disengaging the manufacture from the han-
(Continued)

Figure 1:
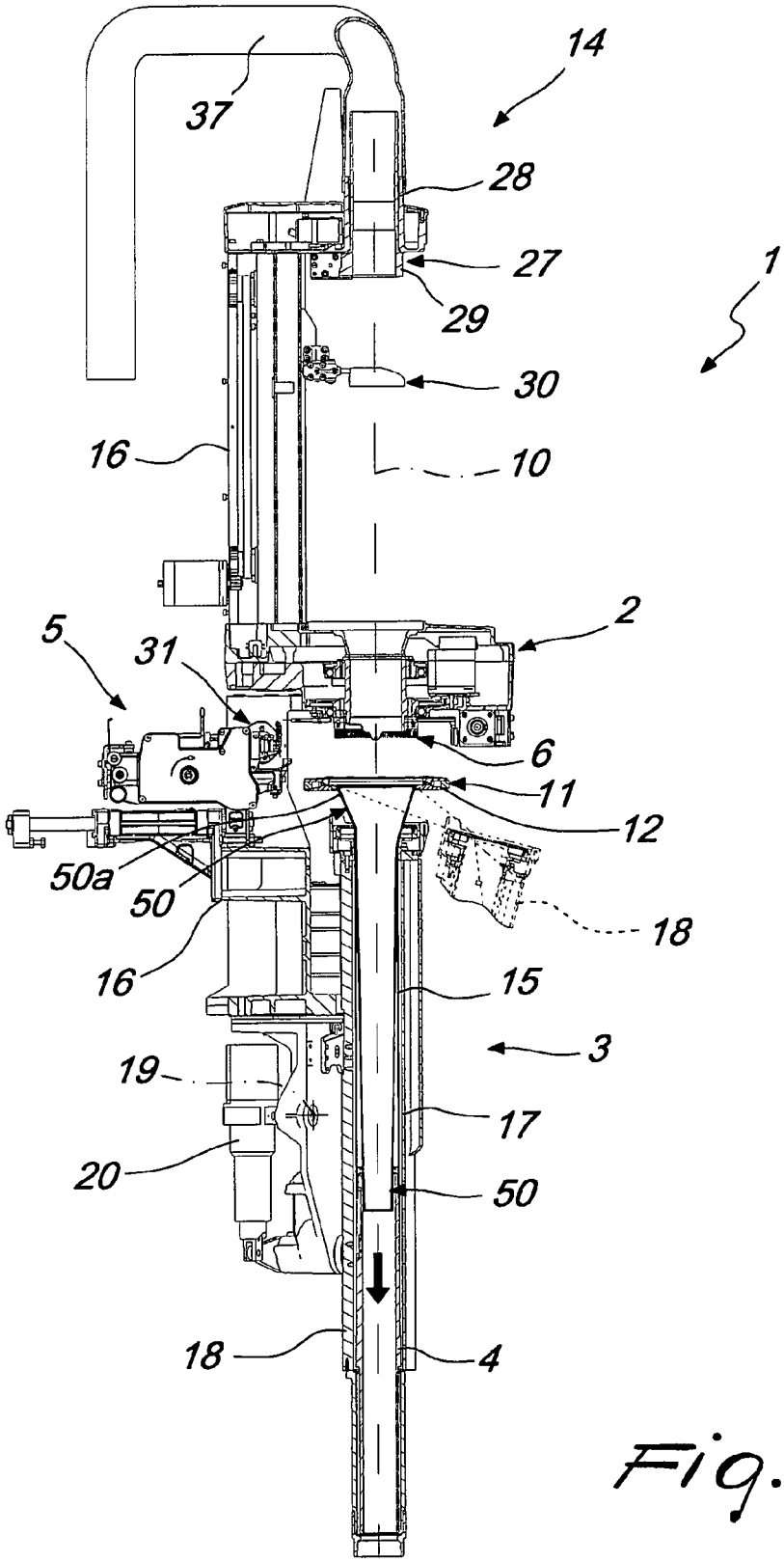

dling device is performed and then a step of moving the manufacture away is performed.

15 Claims, 20 Drawing Sheets

(58) Field of Classification Search
CPC ..... D05B 35/062; D05B 23/00; D04B 9/40; D04B 9/56; D04B 15/88; D04B 15/92
See application file for complete search history.

(56) References Cited

U.S. PATENT DOCUMENTS

| | | | |
|---|---|---|---|
| 6,381,991 | B2 * | 5/2002 | Ando' |
| 6,389,849 | B1 * | 5/2002 | Conti |
| 2004/0168478 | A1 * | 9/2004 | Conti |
| 2005/0115279 | A1 * | 6/2005 | Magni |
| 2007/0101770 | A1 | 5/2007 | Grassi et al. |
| 2009/0049867 | A1 | 2/2009 | Magni et al. |
| 2010/0313607 | A1 * | 12/2010 | Lonati et al. |

FOREIGN PATENT DOCUMENTS

| | | |
|---|---|---|
| EP | 0503495 | 9/1992 |
| EP | 0697479 | 2/1996 |
| IT | MI913258 | 6/1993 |
| JP | 55-80501 | 6/1980 |
| WO | WO 02/070801 | 9/2002 |
| WO | WO 2008/028576 | 3/2008 |
| WO | WO2008/028576 | 3/2008 |
| WO | WO 2009/144049 | 12/2009 |

OTHER PUBLICATIONS

IT MI 20130296 Italian Search Report, dated Nov. 25, 2013.
Office Action regarding related Chinese application No. CN201480010993.9, dated Sep. 23, 2016 (8 pgs.).

* cited by examiner

METHOD FOR PERFORMING THE AUTOMATED CLOSURE OF AN AXIAL END OF A TUBULAR MANUFACTURE AND FOR UNLOADING IT INSIDE OUT AND APPARATUS FOR PERFORMING THE METHOD

The present invention relates to a method for performing the automated closure of an axial end of a tubular manufacture and for unloading it inside out and to an apparatus for performing the method.

Methods and apparatuses are known for performing the automated closure of an axial end of a tubular manufacture, particularly of a hosiery item, at the end of its production cycle, which is performed generally by means of a circular hosiery knitting machine or the like.

In many of these methods and apparatuses, the closure of an axial end of the manufacture is performed by sewing or linking, with the manufacture inside out so that the sewing or linking is practically invisible on the right side of the manufacture. At the end of the sewing or linking operation, the manufacture is disengaged and moved away from the apparatus while also reversing it, i.e., passing it to the right way out configuration.

In particular, patent IT-1.387.067 by the same Applicant discloses a method and an apparatus that allow to close an axial end of a tubular manufacture. The apparatus described in such patent comprises a sewing or linking station in which there is an annular handling device that is adapted to retain the manufacture, arranged so that its axis is substantially vertical and hanging from said handling device by means of a first axial end thereof, which constitutes the axial end that must be closed by sewing or linking. The handling device comprises an annular body that can engage said first axial end of the manufacture. The annular body is composed of two semi-annular portions which are mutually pivoted about a diametrical axis of the annular body and one of these two semi-annular portions can rotate about the diametrical axis with respect to the other semi-annular portion so as to pass from a co-planar position to a position in which it faces the other semi-annular portion. The annular body is provided with a plurality of spikes which, when the two semi-annular portions of the annular body are co-planar, lie parallel to the axis of the annular body and are distributed along the circumferential extension of the annular body. When one semi-annular portion is arranged so as to face the other semi-annular portion of the annular body, the spikes of one semi-annular portion face and are aligned with the spikes of the other semi-annular portion of the annular body.

In the apparatus disclosed in patent IT-1.387.067, to which reference is made for completeness in description, the tubular manufacture, at the end of its production, is taken from the circular hosiery knitting machine that produced it and is transferred to the handling device arranged at the sewing or linking station. More particularly, the loops of knitting of the last row of knitting that has been formed are each transferred from a needle of the hosiery knitting machine to a spike of the annular body of the handling device with the two semi-annular portions in a coplanar position. The manufacture, which hangs with its axial end to be closed from the handling device and is extended below it, is aspirated into a lower reversing tube, which has a substantially vertical axis, is supported below the handling device and faces, with its upper axial end, the annular body of the handling device. In this condition, the manufacture is right way out. The lower reversing tube is then raised and made to pass through the annular body of the handling device, causing the eversion of the tubular manufacture onto the outer lateral surface of said lower reversing tube. In this manner, the manufacture is engaged, by means of its first axial end, again with the spikes of the annular body of the handling device, but is extended, in the inside out configuration, above said annular body of the handling device. A semi-annular portion of the annular body of the handling device is then rotated about the diametrical axis so that its spikes face the spikes of the other semi-annular portion and the loops carried by the spikes of one semi-annular portion are passed onto the spikes of the other semi-annular portion, so that each one of these spikes supports two loops of knitting. A sewing or linking head joins the several pairs of loops carried by the spikes of one semi-annular portion and the manufacture is disengaged from the spikes of the handling device and aspirated into the lower reversing tube through its lower axial end, which lies above the annular body of the handling device. Due to this suction, the manufacture, the first axial end of which has been closed, again assumes the right way out configuration and is moved away, in this configuration, from the apparatus used to close said axial end.

Generally, it is preferred that the manufacture, at the end of its production cycle and of the closure of one of its axial ends, is in the right way out configuration, since in this condition it can be subjected to the several finishing operations and then packaged.

However, in some cases it is required that the manufacture be unloaded from the apparatus used to close one of its axial ends in the inside out configuration, so that it can be subjected to at least part of the finishing operations in the inside out configuration. This requirement is particularly felt for example for stockings or other tubular manufactures that have patterns or particular treatments that leave trailing strands of thread on the reverse side of the manufacture, and which, during the finishing operations, might be pushed to exit from the right side of the manufacture, becoming then visible on the finished manufacture.

Similar requirements occur when the finishing operations are particularly vigorous with respect to the threads or treatments performed and which, for this reason, if applied to the right side of the manufacture, might damage it or alter its aesthetics.

The aim of the present invention is to meet this requirement, by devising a method that allows to perform the automated closure of an axial end of a tubular manufacture and to unload it inside out.

Within this aim, an object of the invention is to devise a method that can be performed in a relatively simple manner and with high reliability and precision.

Another object of the invention is to provide an apparatus for performing the method according to the invention that is relatively simple to provide.

Another object of the invention is to provide an apparatus for performing the method according to the invention that can be derived, with modifications that are simple to provide, from known apparatuses, for example of the type disclosed in patent IT-1.387.067.

A further object of the invention is to devise a method and an apparatus that allow to close an axial end of a tubular manufacture and to unload it inside out in an economically competitive manner.

This aim, as well as these and other objects that will become better apparent hereinafter, are achieved by a method for closing an axial end of a tubular manufacture and for unloading it inside out, comprising in sequence:

a step of positioning the manufacture right way out at a sewing or linking station, arranged so that its axis is substantially vertical and so that it hangs, by means of a first axial end to be closed by sewing or linking, from an annular handling device, said manufacture being extended below said handling device;

a step of turning the manufacture inside out, in which the manufacture, retained by said handling device, is passed through said handling device, said passage arranging the manufacture inside out above said handling device;

a step of closing said first axial end of the manufacture by sewing or linking;

a step of disengaging the manufacture from said handling device;

a step of moving the manufacture away by means of suction through the upper axial end of a lower spacing tube that faces, with its upper axial end, below said handling device.

Figure 1A:
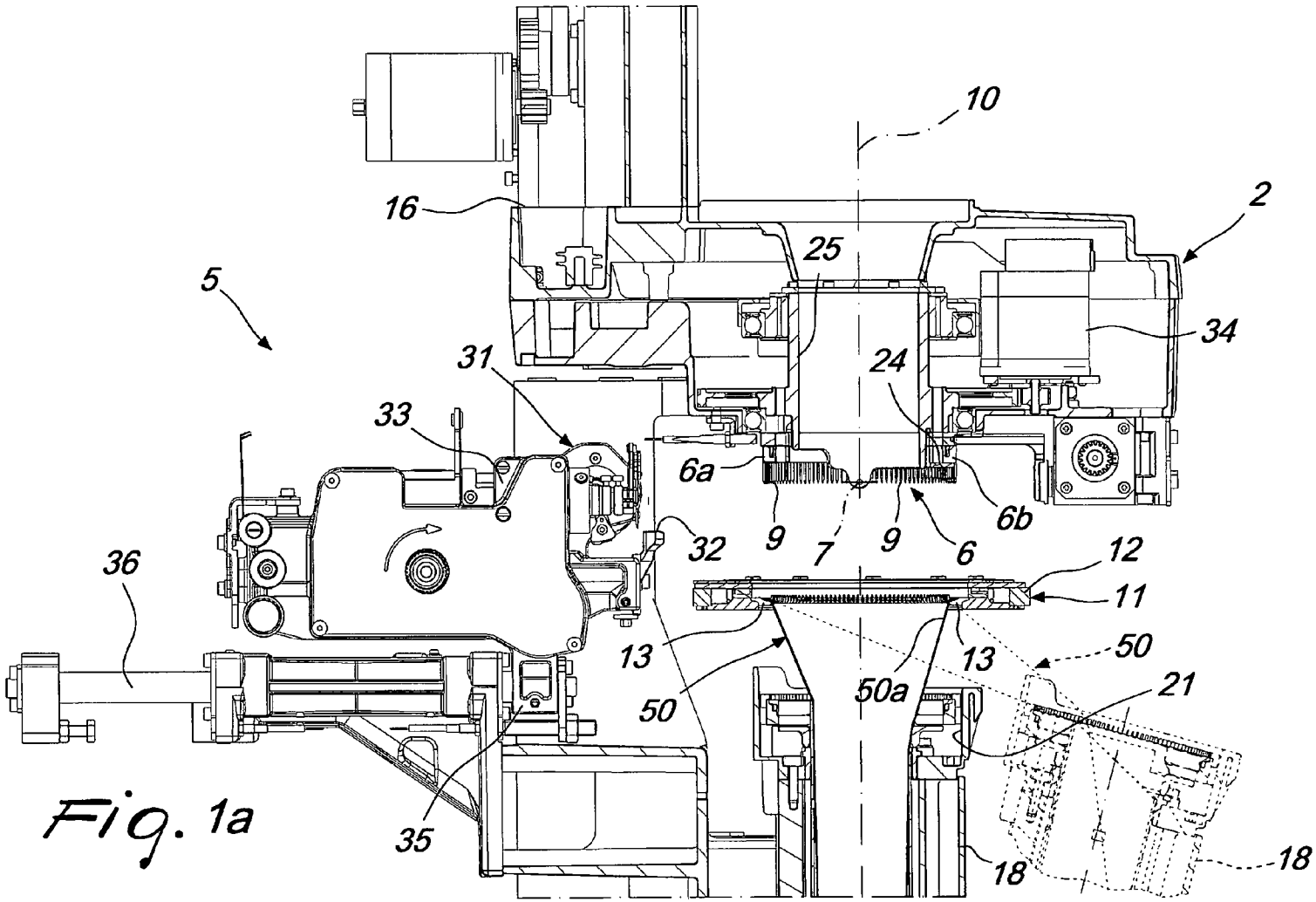
Figure 2:
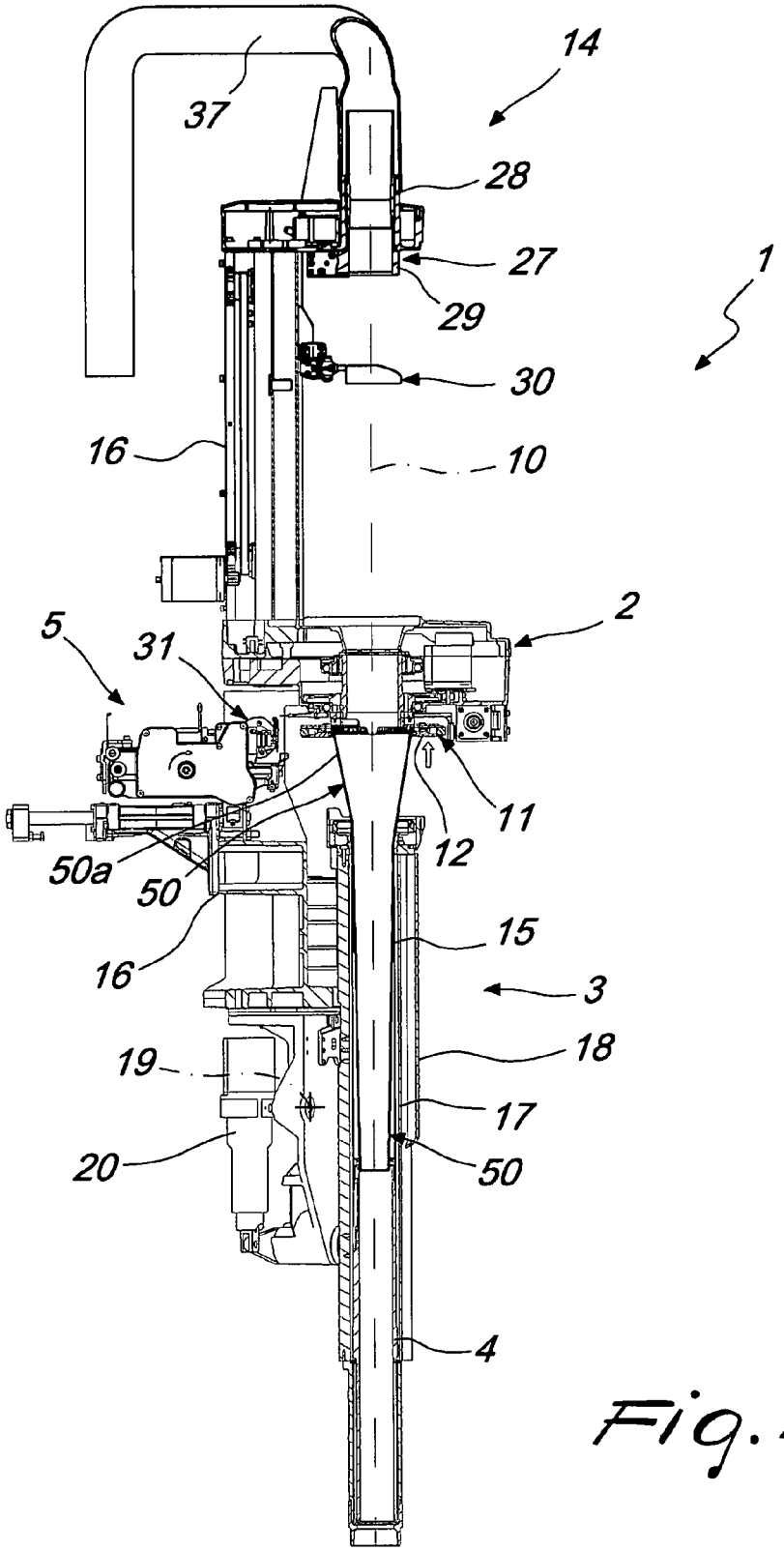
Figure 2A:
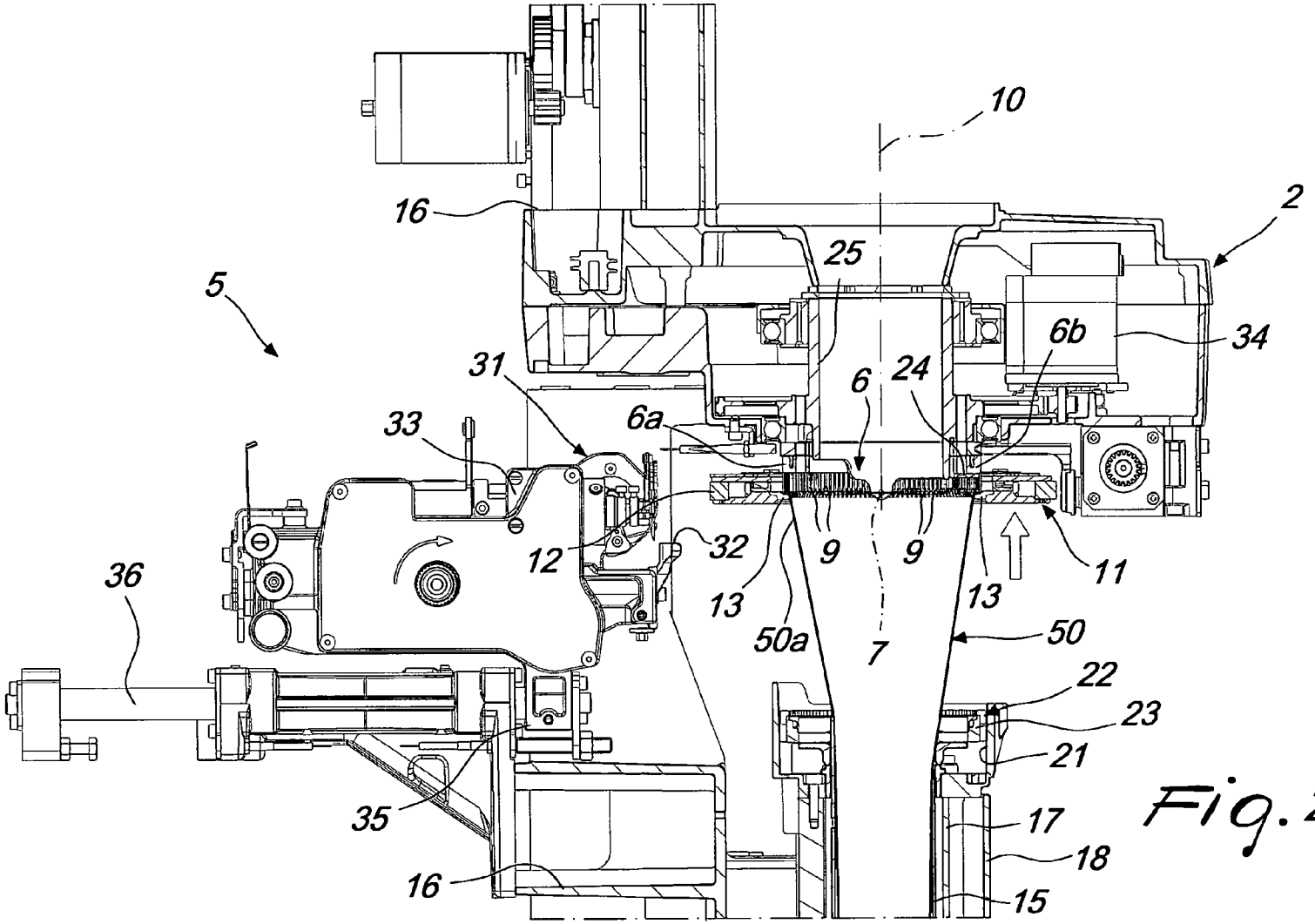
Figure 3:
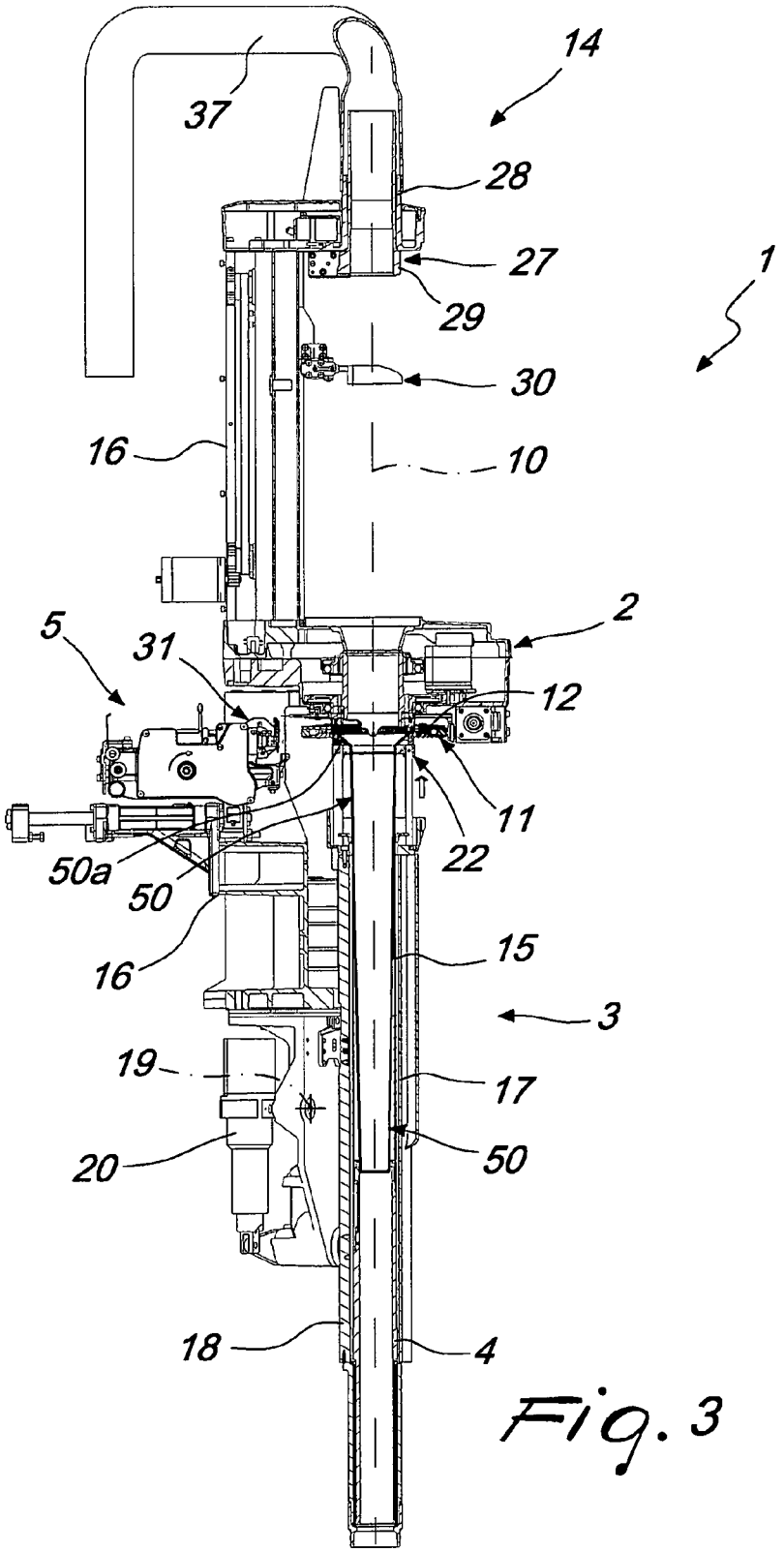
Figure 3A:
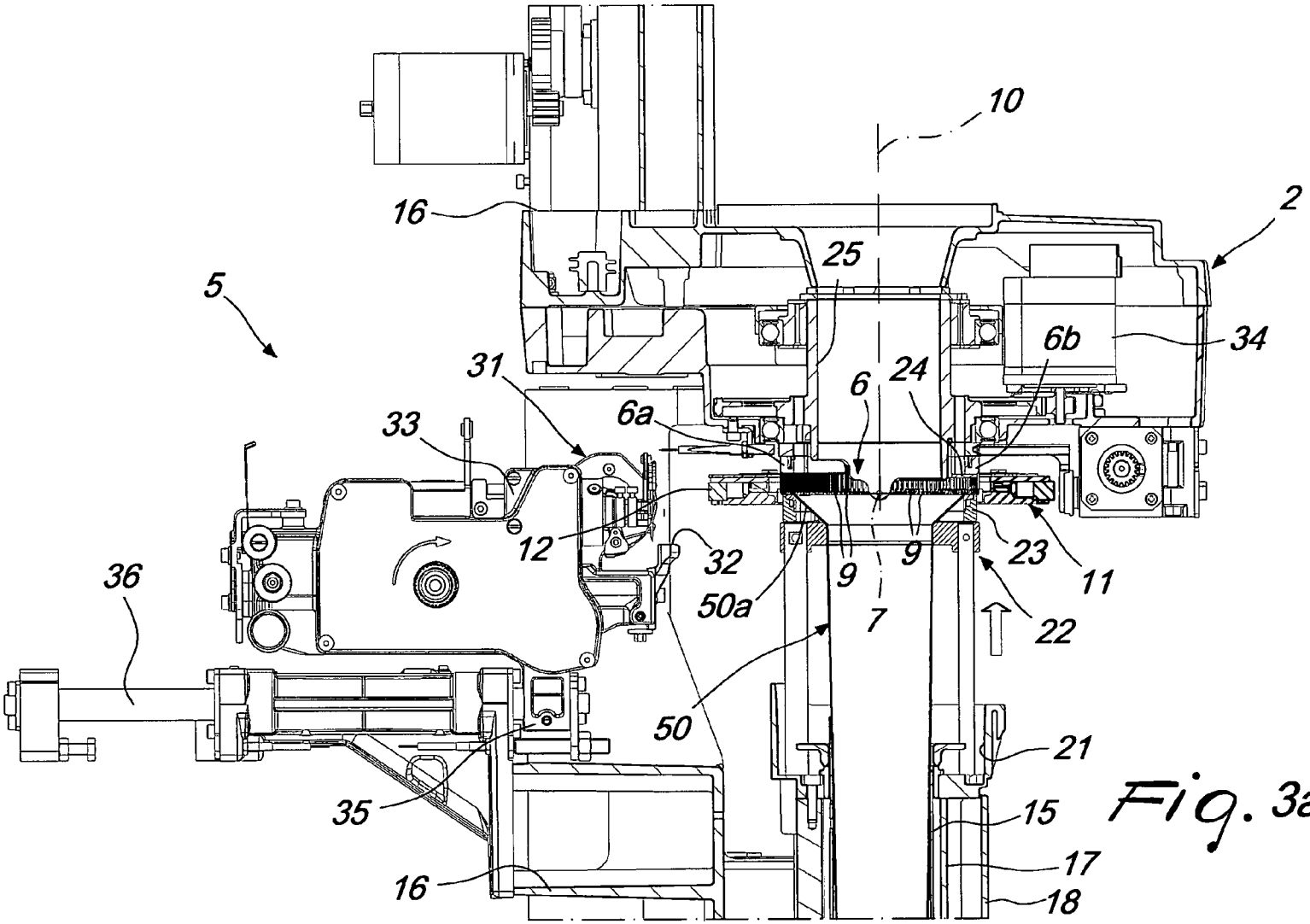
Figure 4:
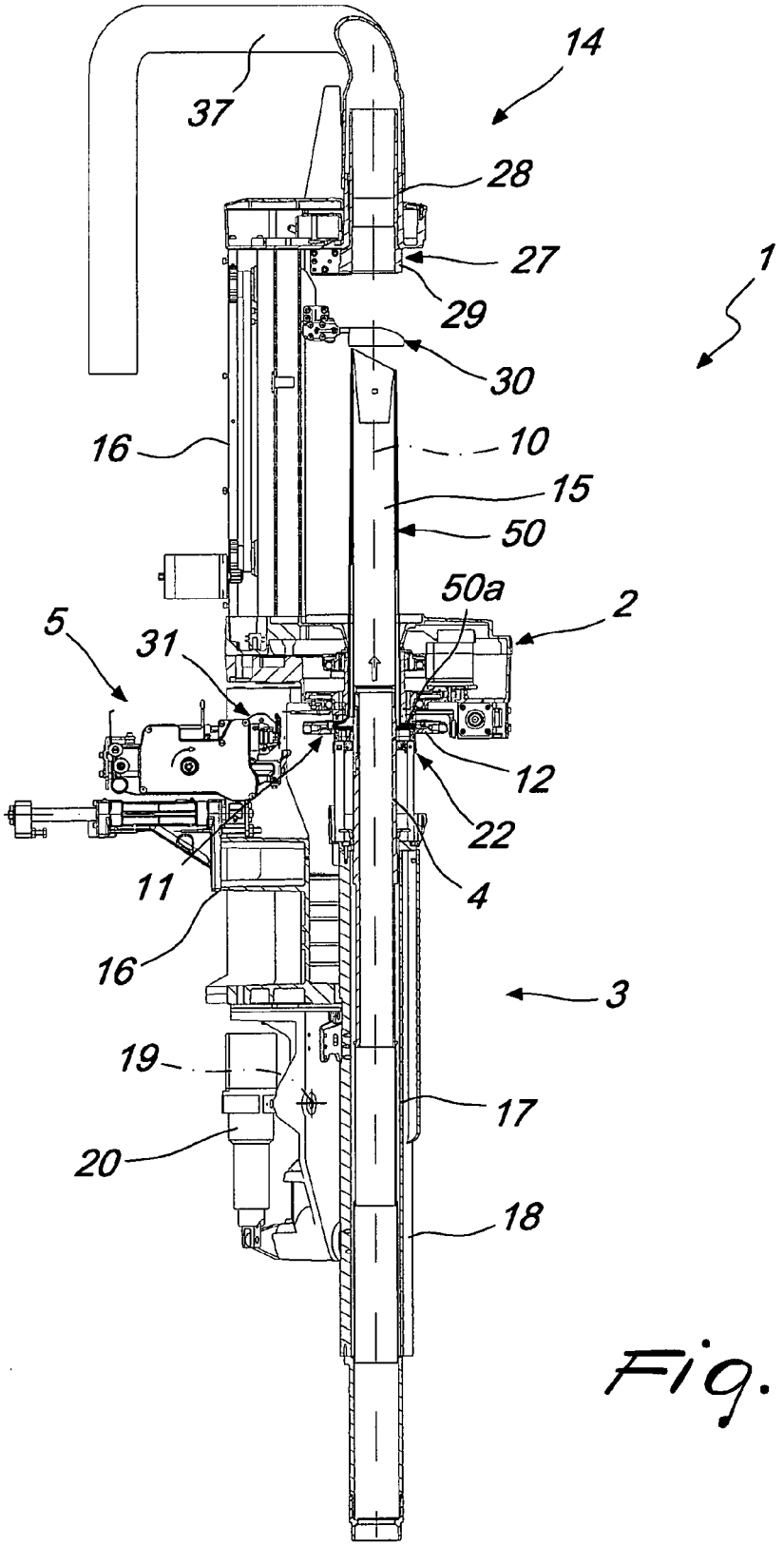
Figure 4A:
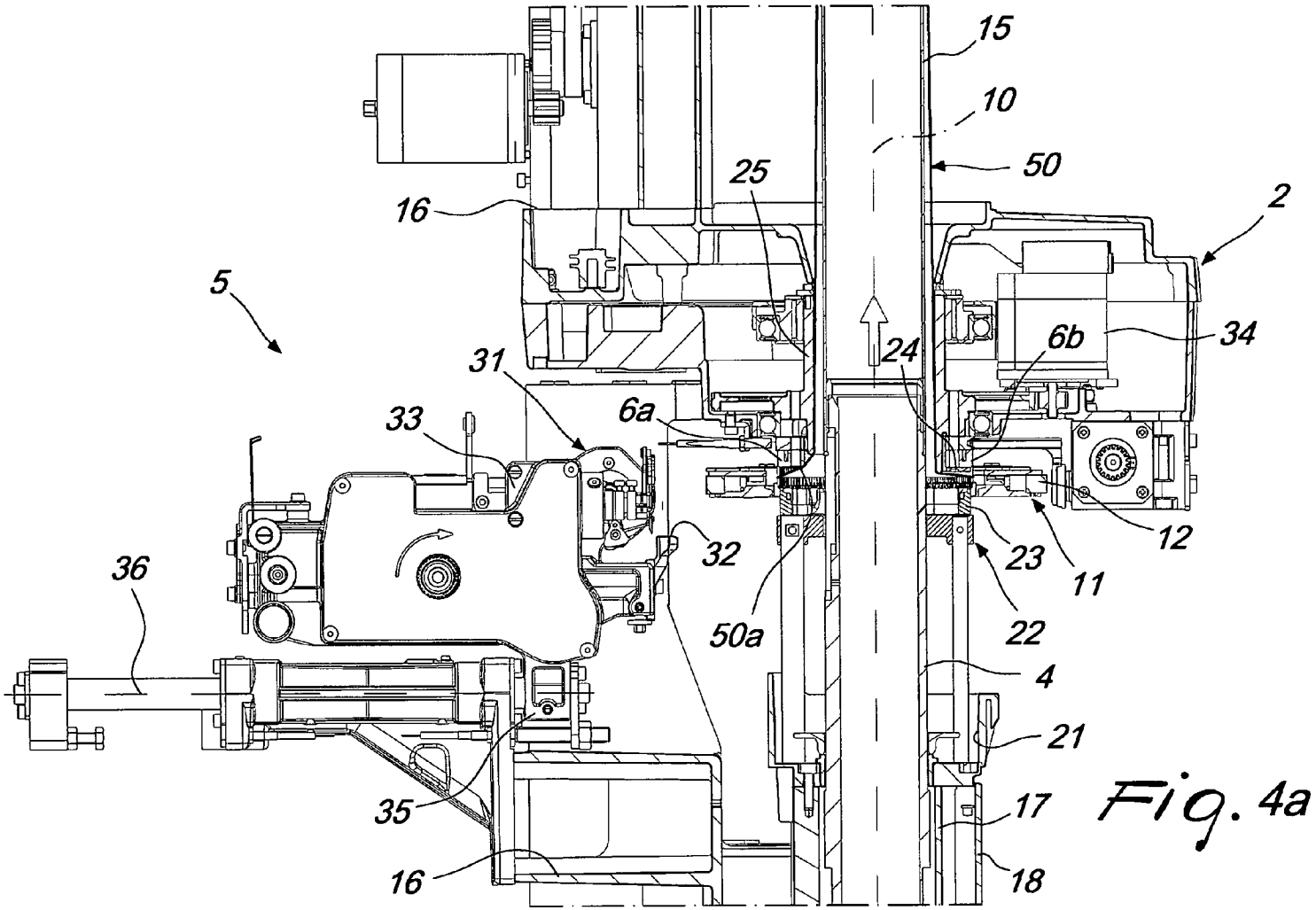
Figure 5:
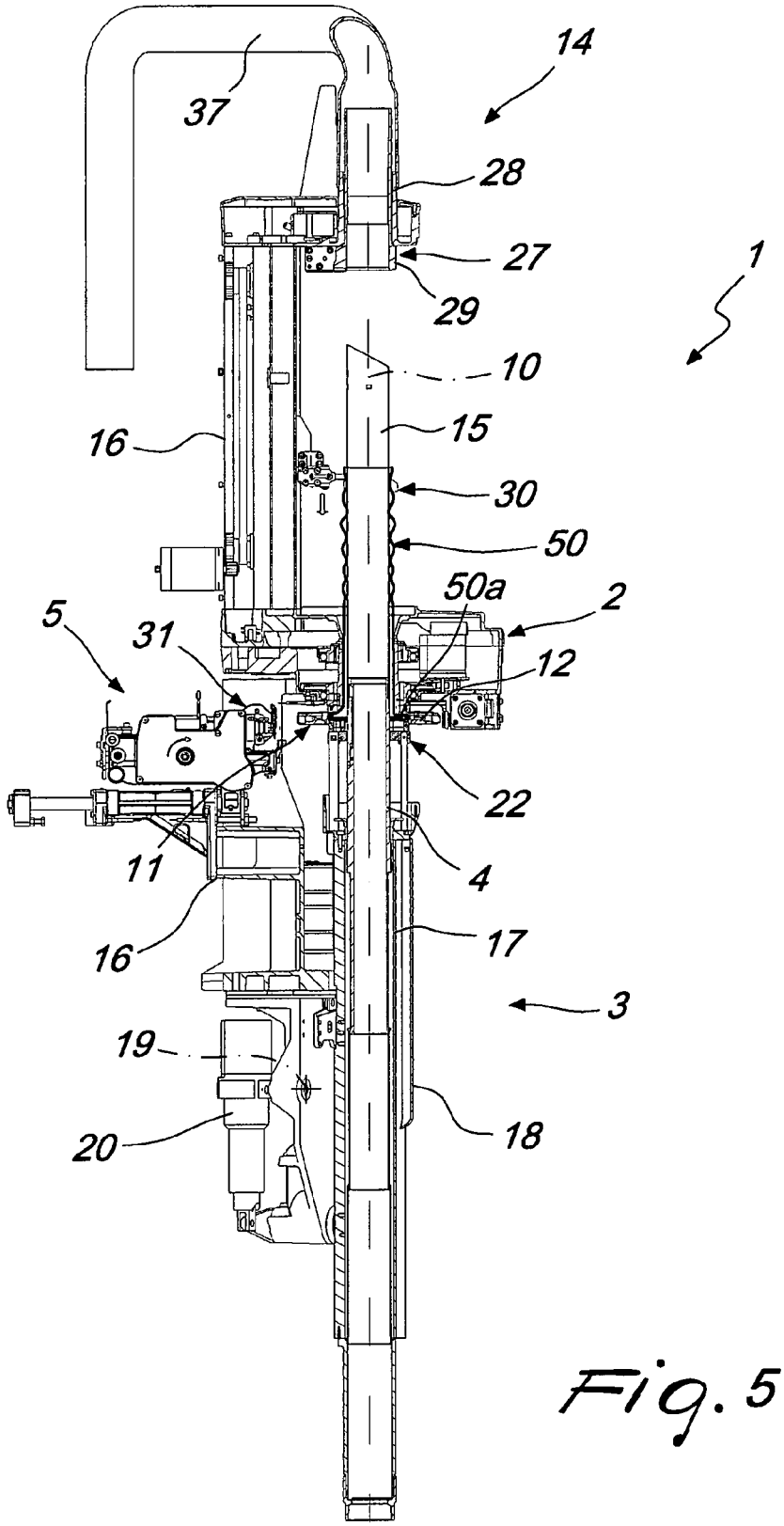
Figure 5A:
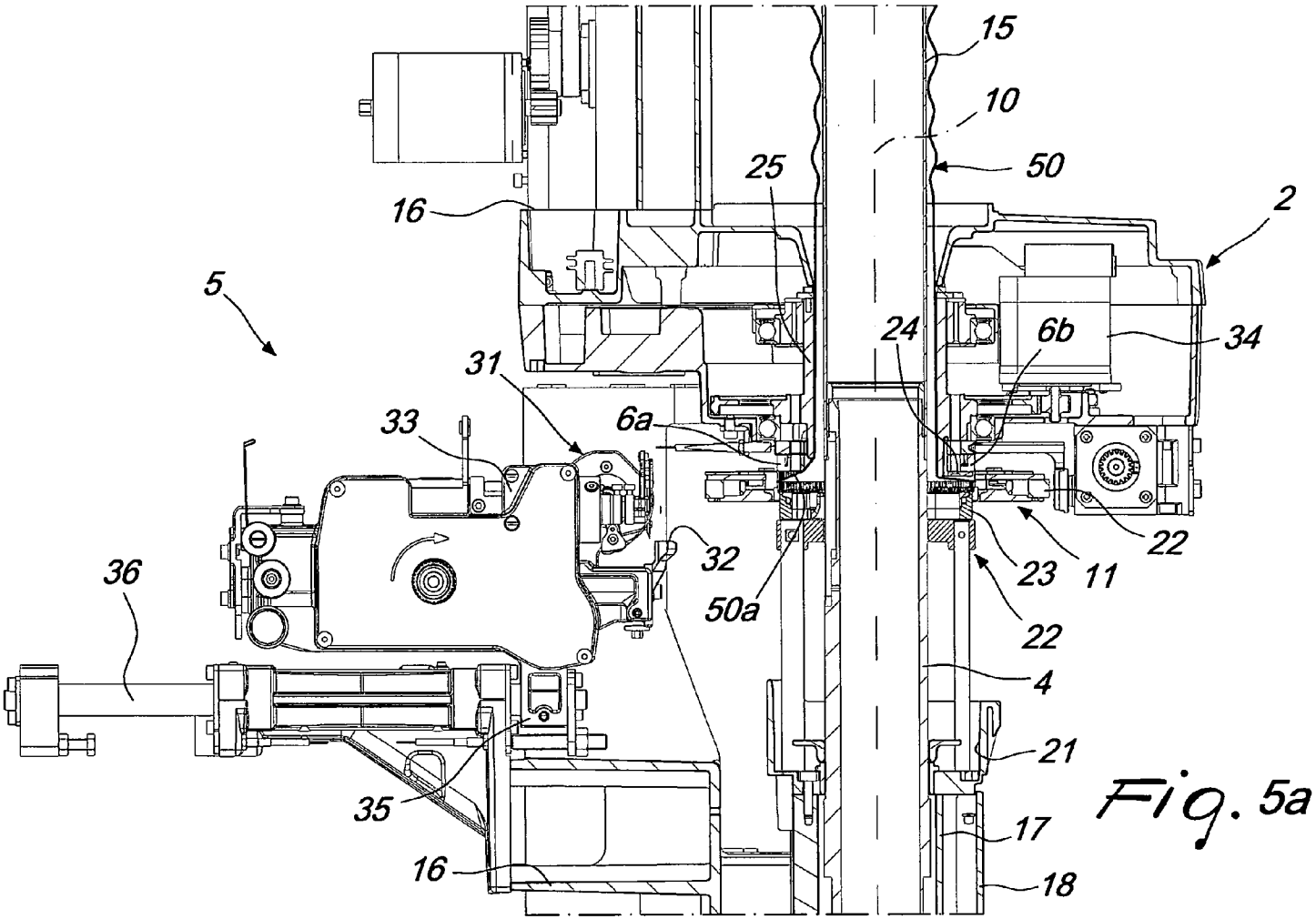
Figure 6:
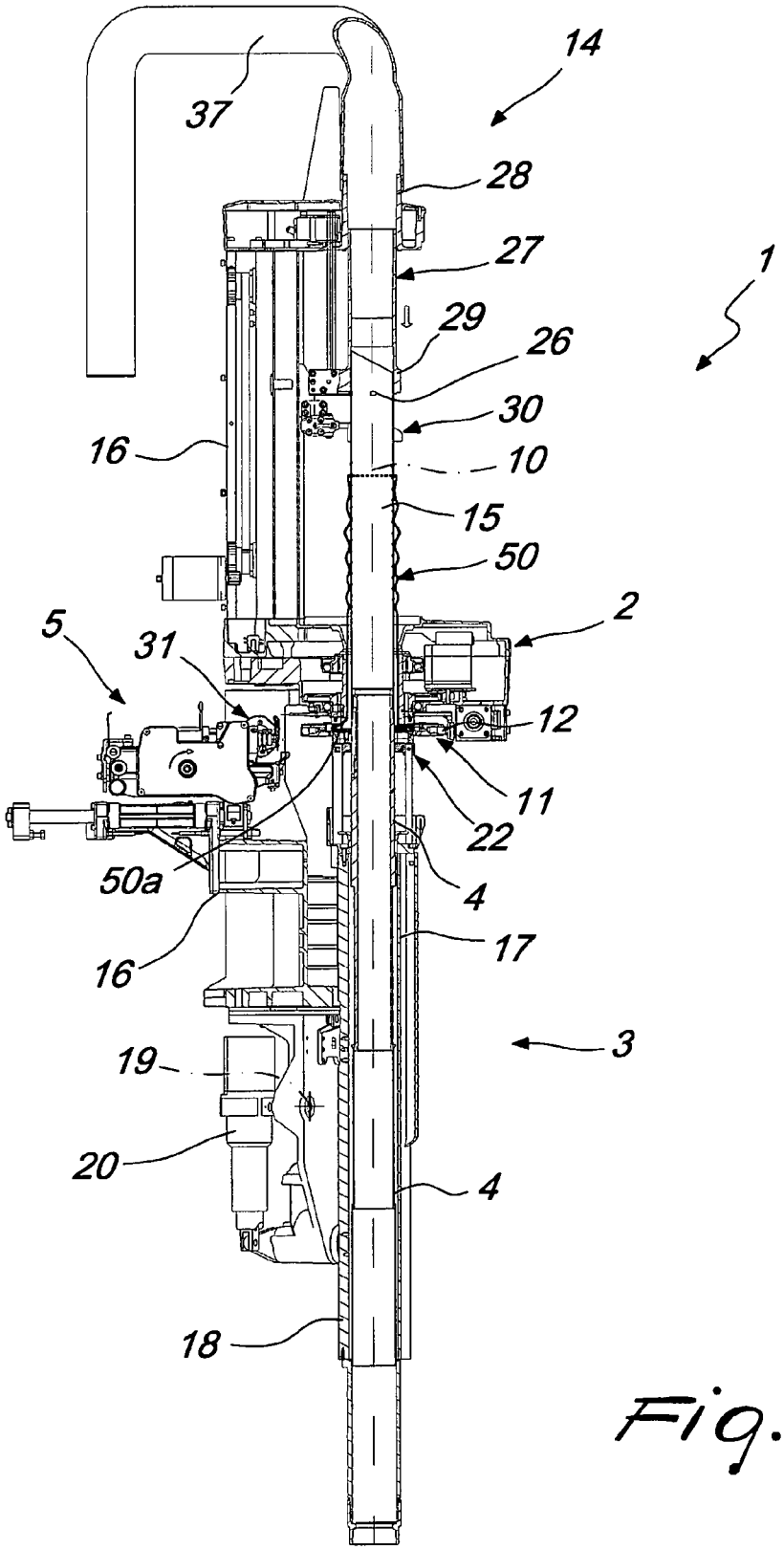
Figure 6A:
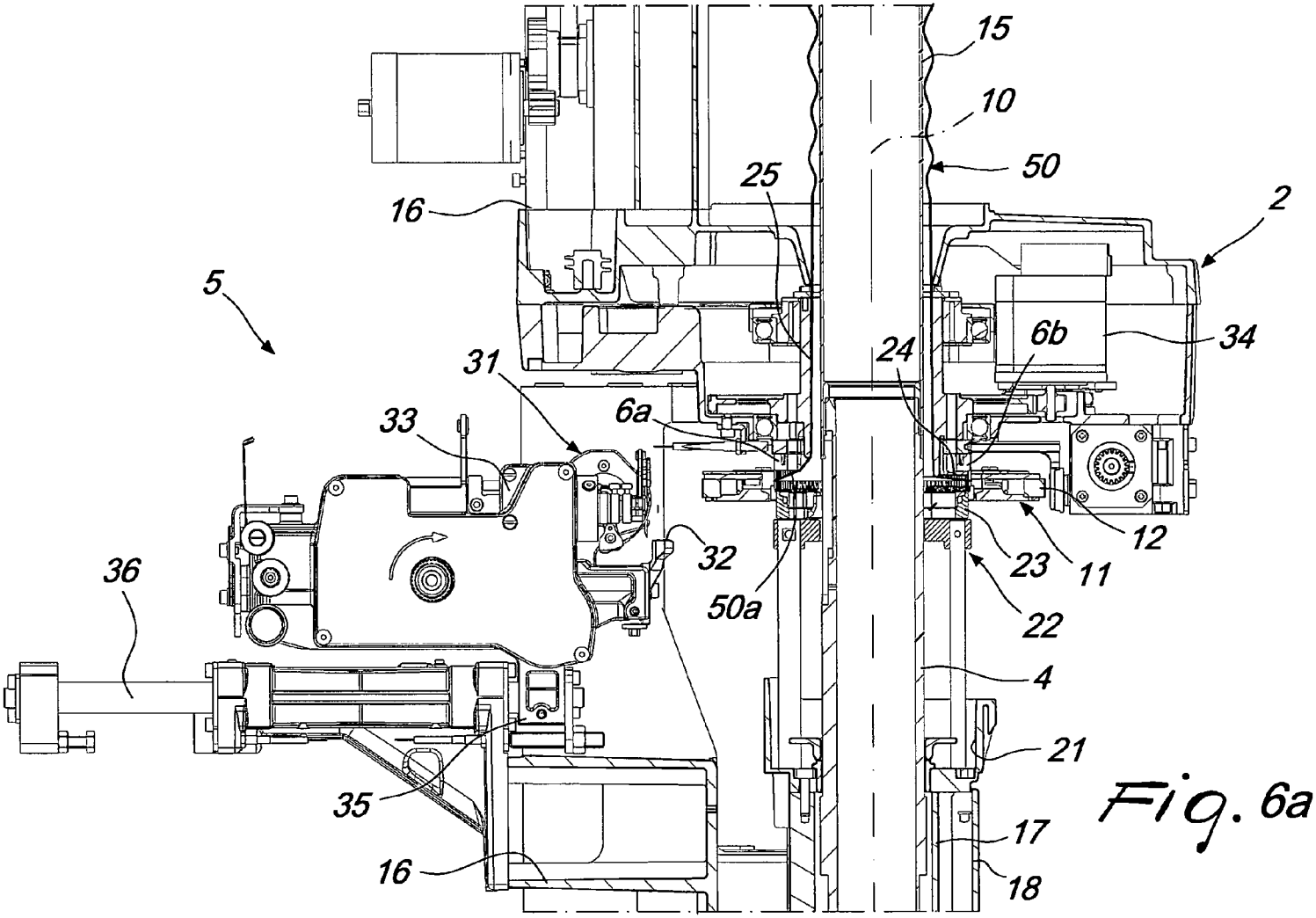
Figure 7:
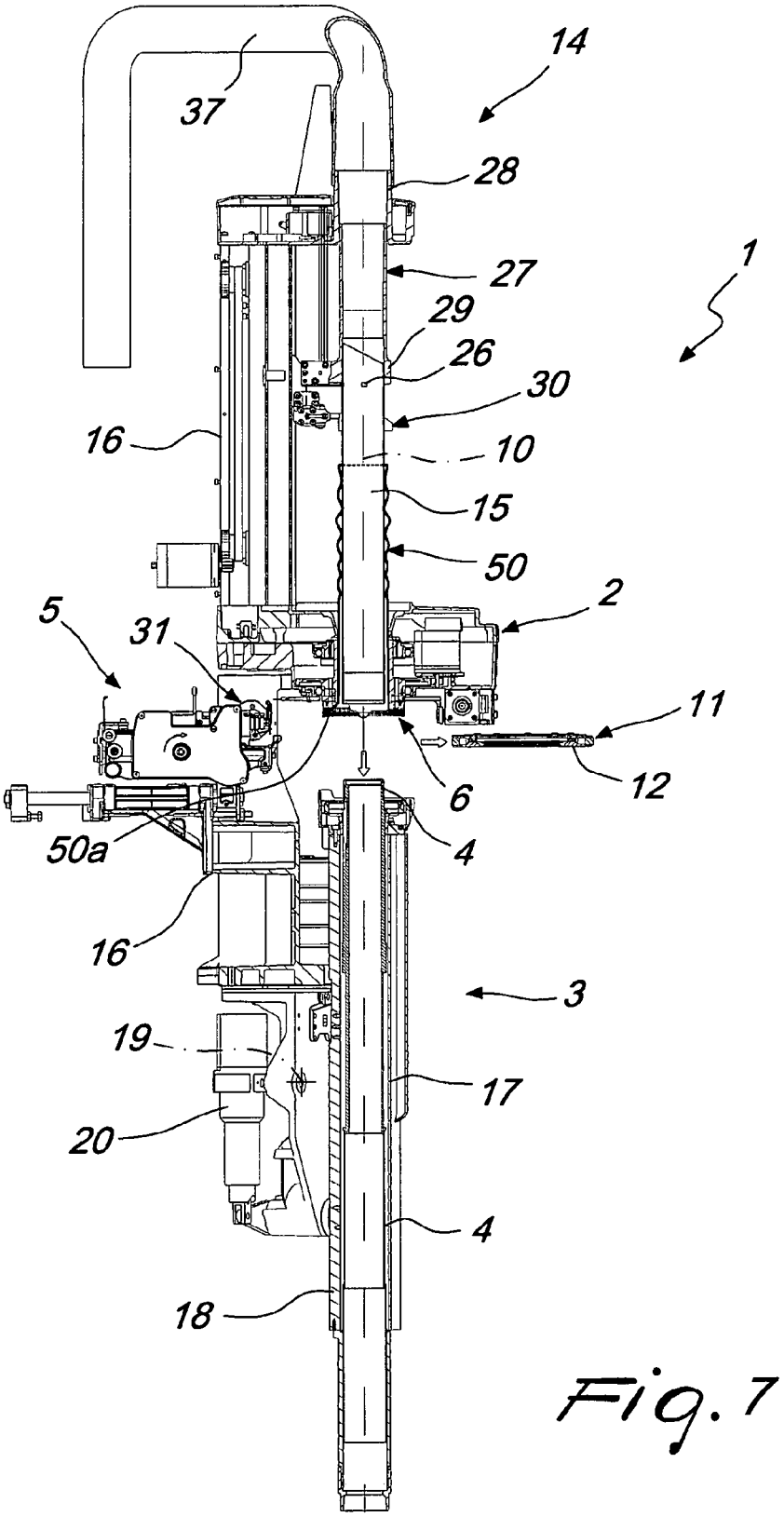
Figure 7A:
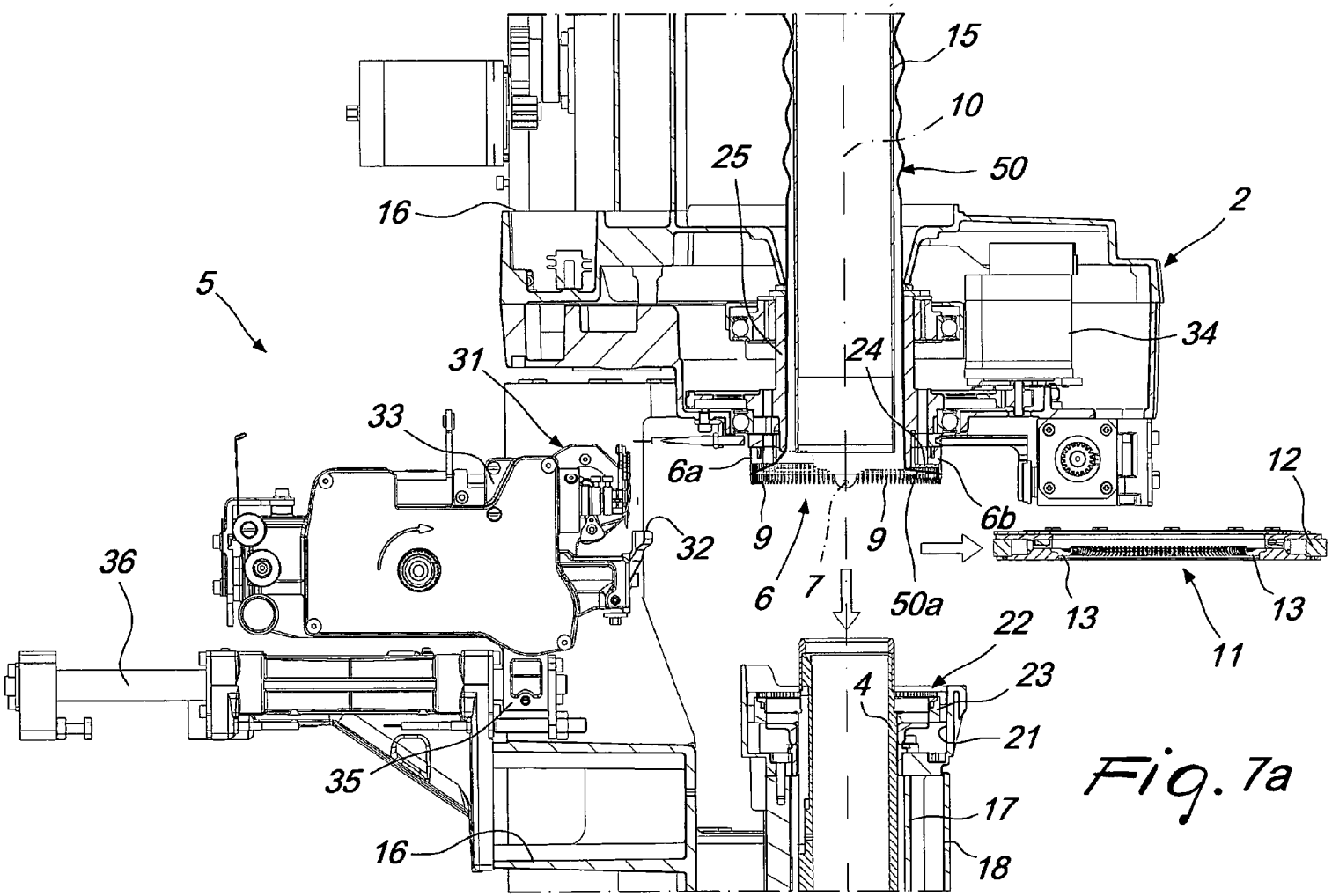
Figure 8:
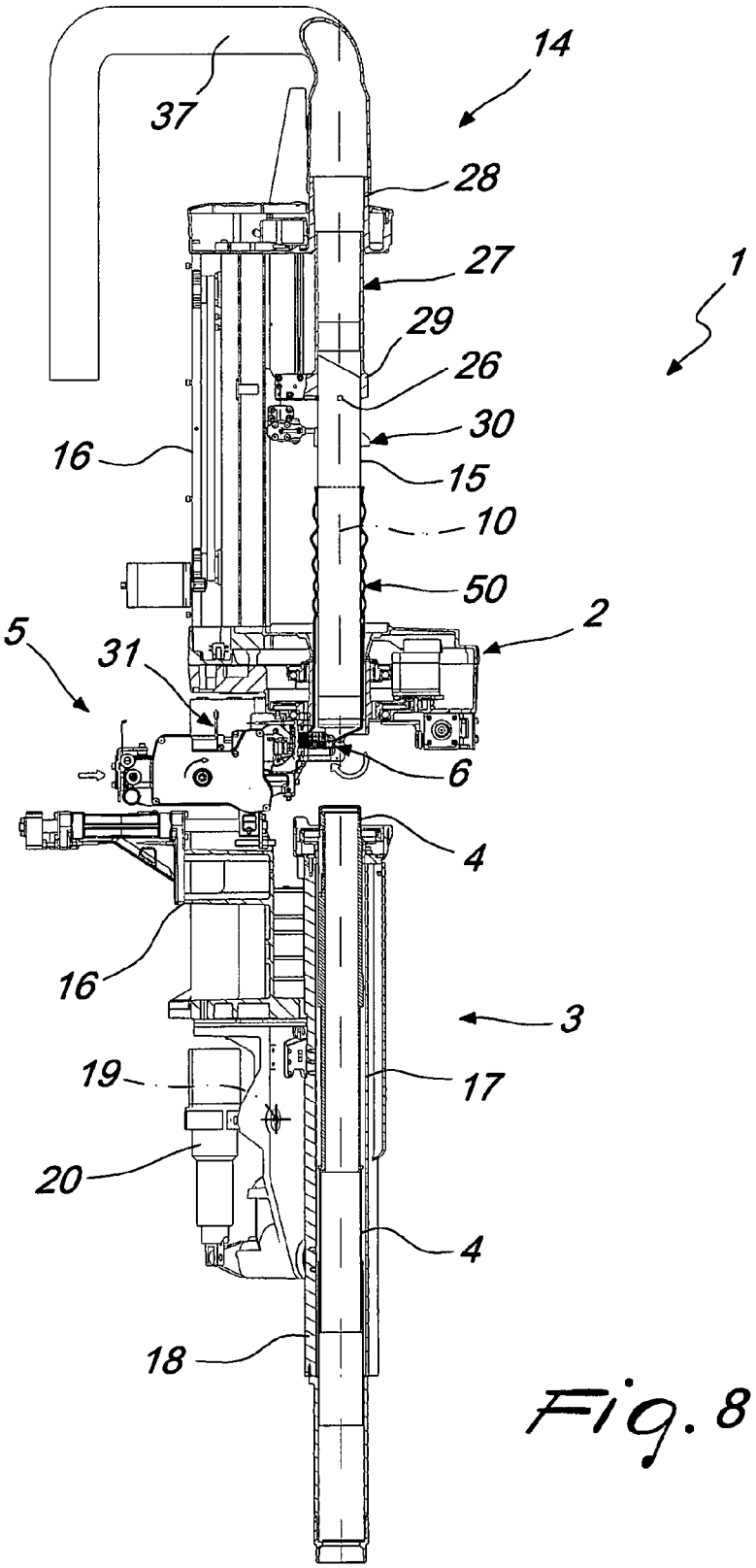
Figure 8A:
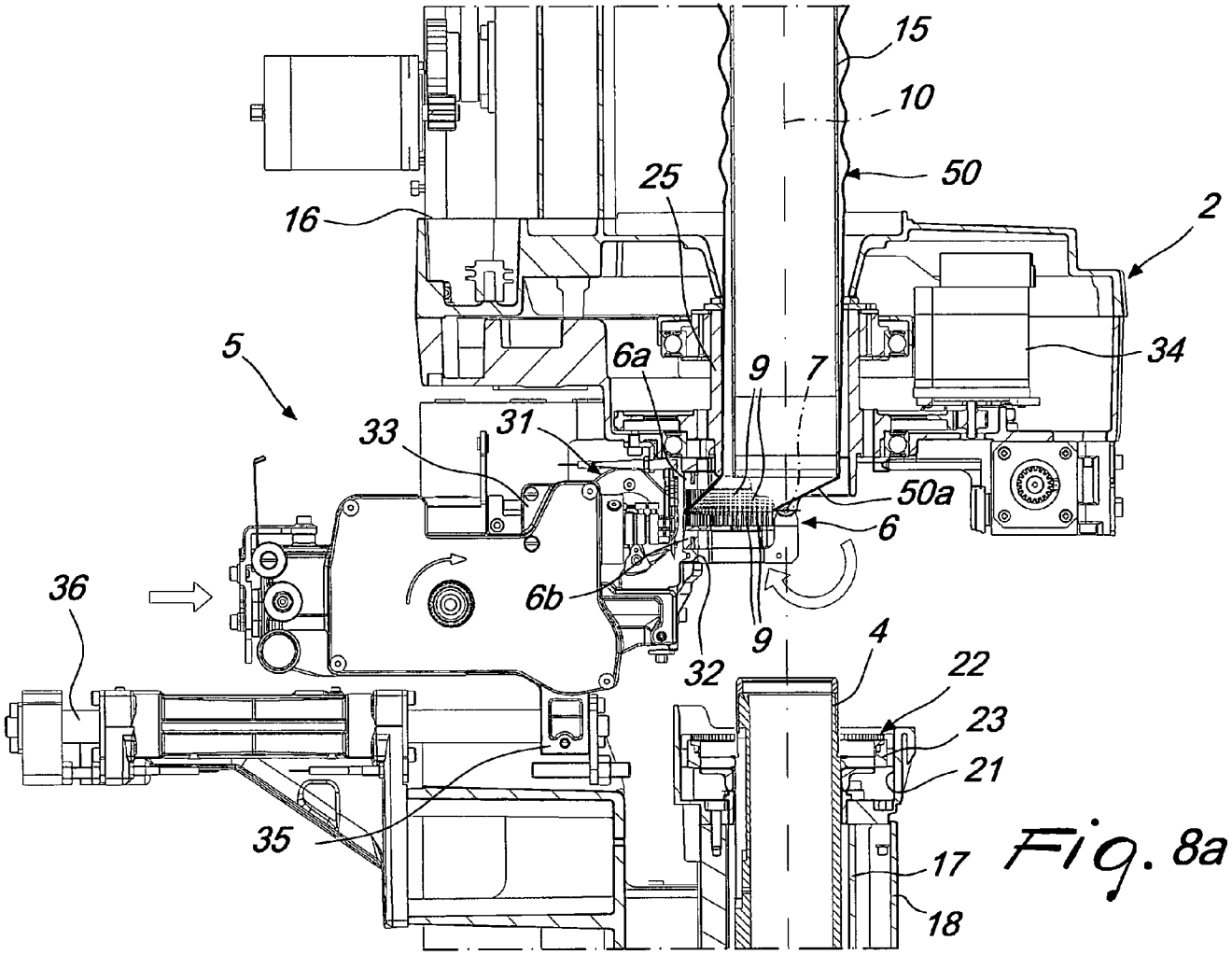
Figure 9:
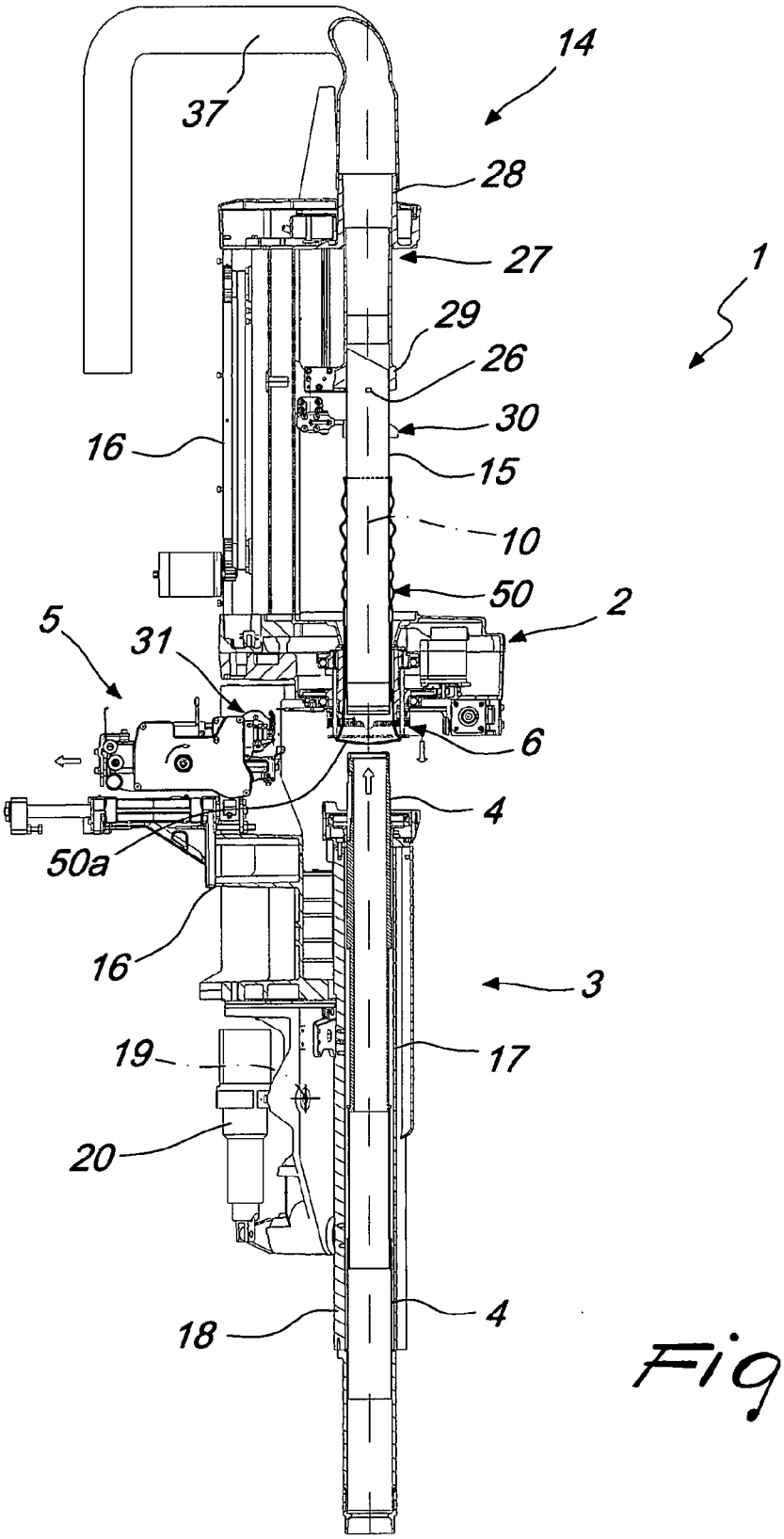
Figure 9A:
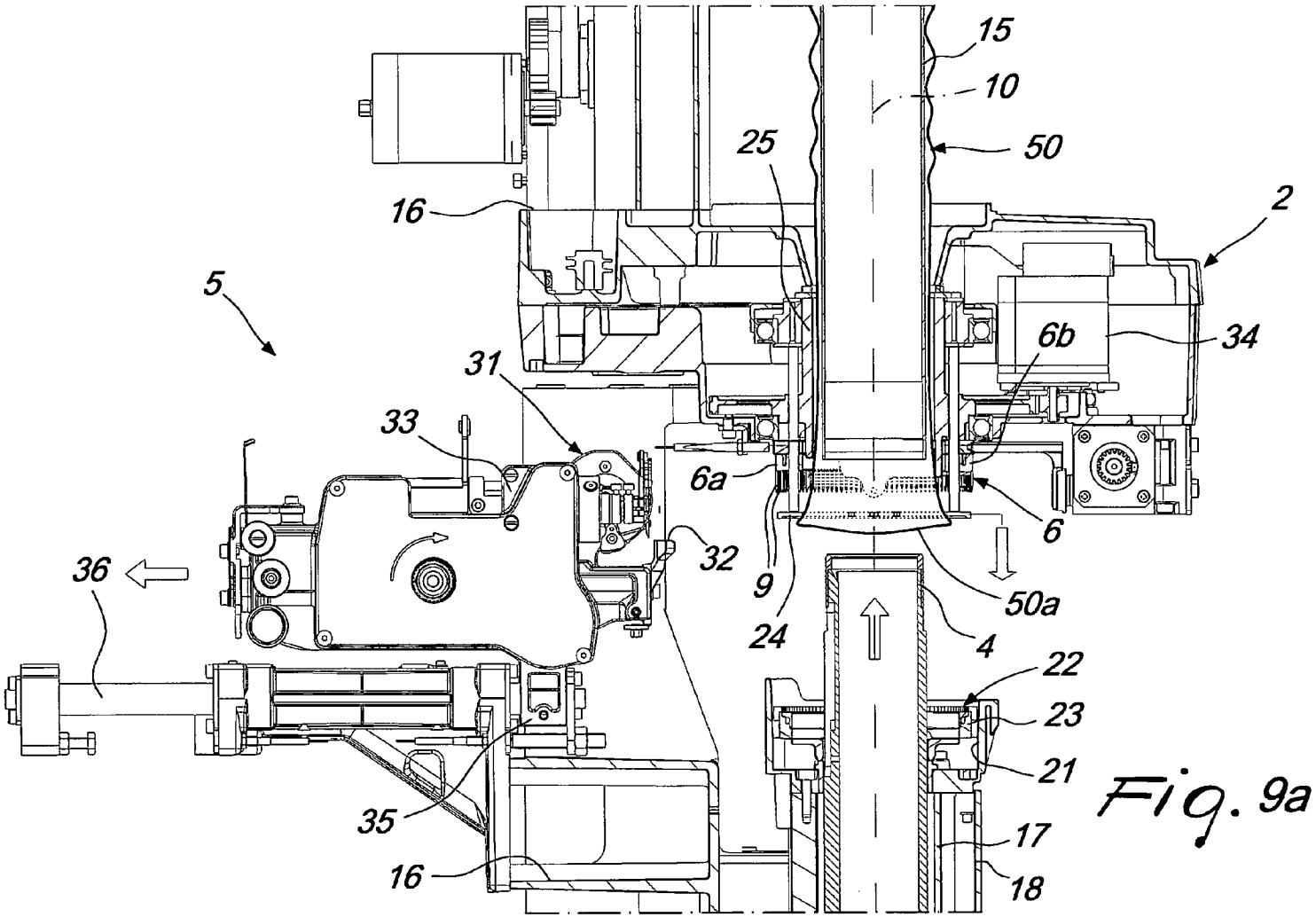
Figure 10:
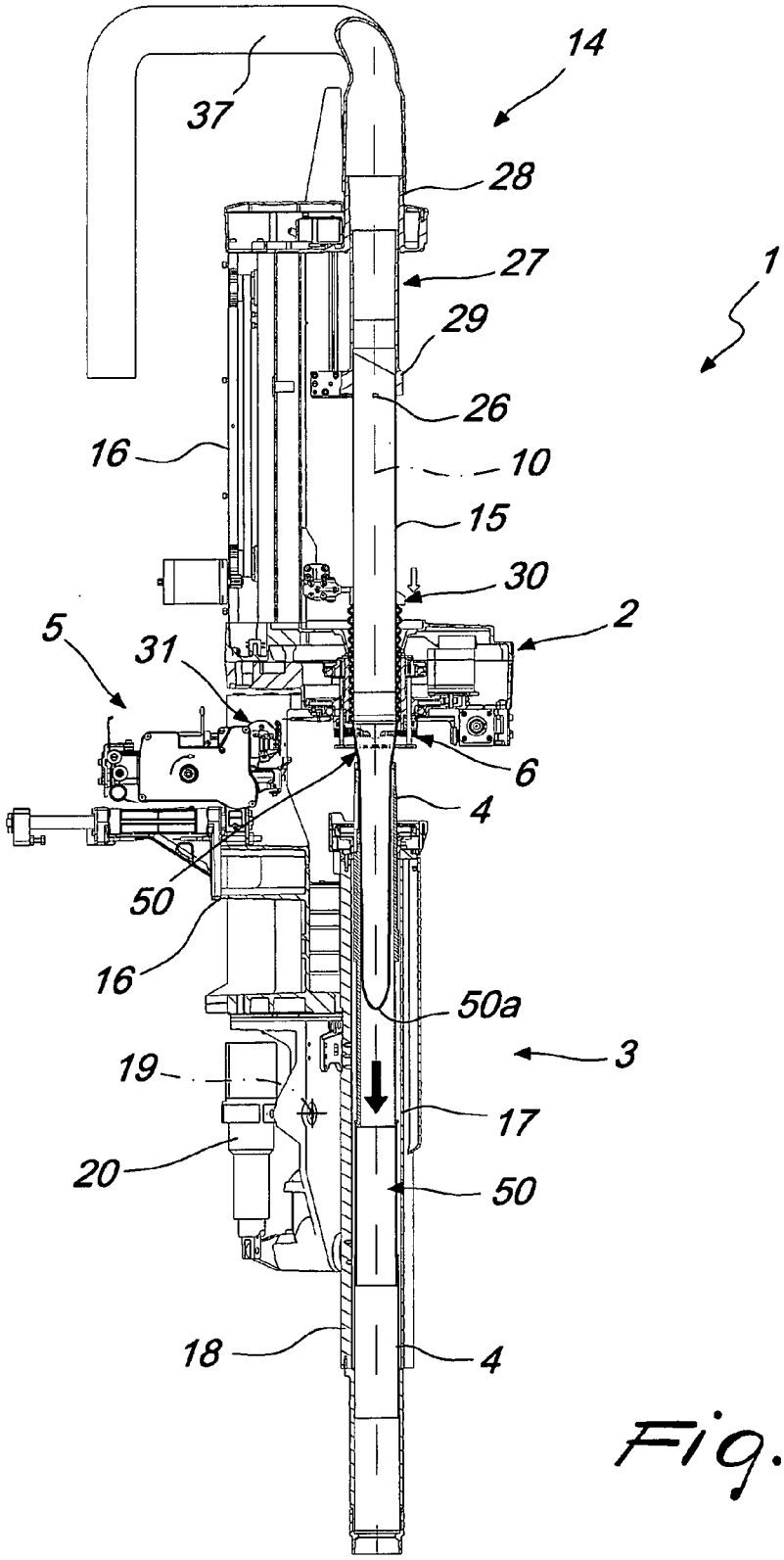
Figure 10A:
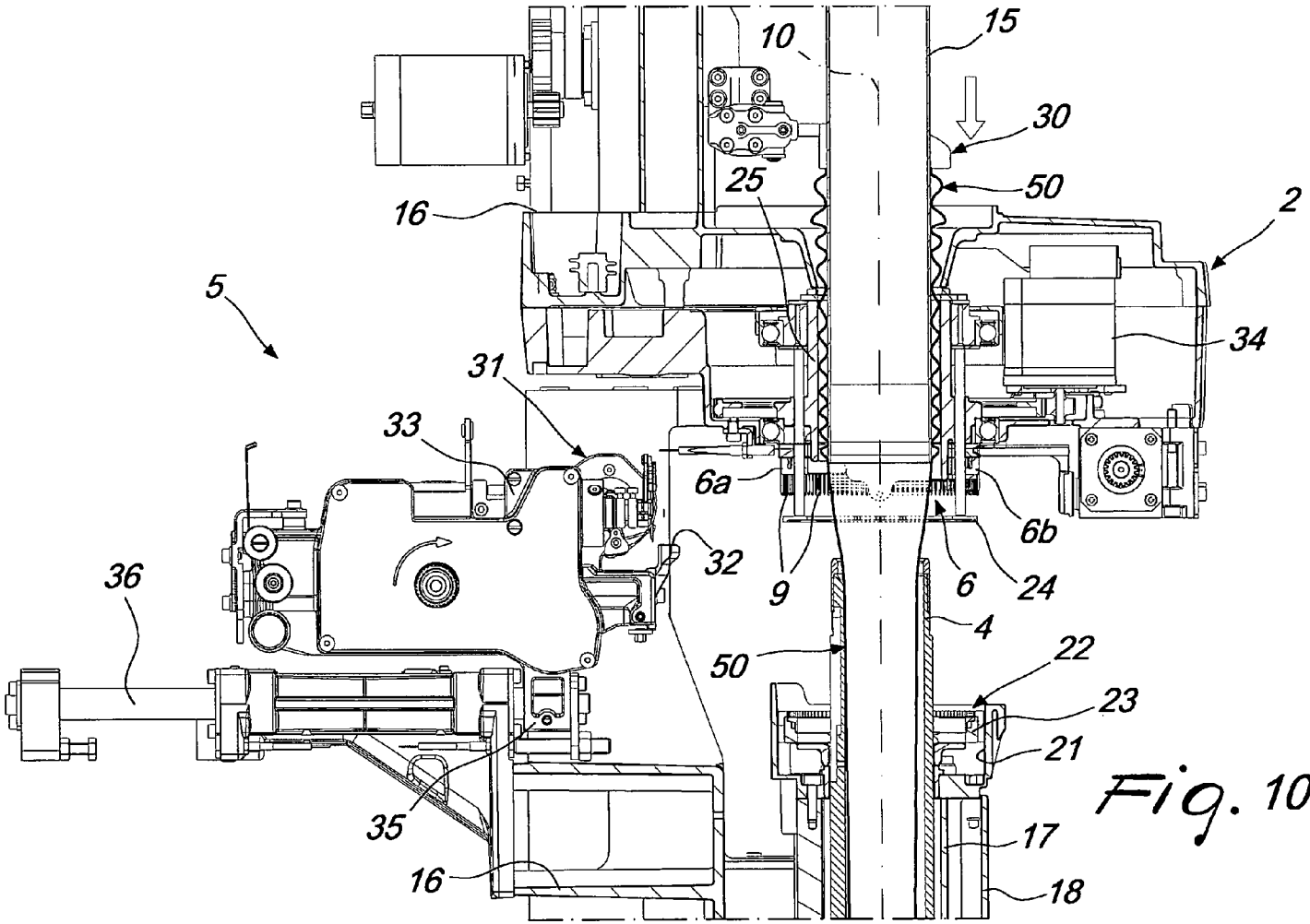

Further characteristics and advantages of the invention will become better apparent from the description of a preferred but not exclusive embodiment of the method according to the invention and of the apparatus for performing it, illustrated by way of nonlimiting example in the accompanying drawings, wherein:

FIGS. 1 to 10 are schematic views of the sequence of steps of the method according to the invention with the apparatus for performing it shown schematically and in cross-section along a vertical plane;

FIG. 1*a* is an enlarged-scale view of a detail of FIG. 1;

FIG. 2*a* is an enlarged-scale view of a detail of FIG. 2;

FIG. 3*a* is an enlarged-scale view of a detail of FIG. 3;

FIG. 4*a* is an enlarged-scale view of a detail of FIG. 4;

FIG. 5*a* is an enlarged-scale view of a detail of FIG. 5;

FIG. 6*a* is an enlarged-scale view of a detail of FIG. 6;

FIG. 7*a* is an enlarged-scale view of a detail of FIG. 7;

FIG. 8*a* is an enlarged-scale view of a detail of FIG. 8;

FIG. 9*a* is an enlarged-scale view of a detail of FIG. 9;

FIG. 10*a* is an enlarged-scale view of a detail of FIG. 10.

With reference to the figures, an apparatus for performing the method according to the invention, generally designated by the reference numeral 1, comprises: an annular handling device 2, which can be engaged with a first axial end 50*a* of the manufacture 50 to be closed by sewing or linking, a reversing device 3, which is adapted to move the manufacture 50, which hangs with its first axial end 50*a* from said handling device 2, to the inside out configuration above the handling device 2, a lower spacing tube 4, which faces with its upper axial end below the handling device 2, and means 5 for sewing or linking the first axial end 50*a* of the manufacture 50, which can be operated to close the first axial end 50*a* of the manufacture 50 that is engaged with the handling device 2 and is arranged inside out above the handling device 2.

Preferably, the handling device 2 comprises an annular body 6 that is composed of two semi-annular portions 6*a*, 6*b*, which are pivoted to each other about a diametrical axis 7. In one operating condition, as will become better apparent hereinafter, the two semi-annular portions 6*a*, 6*b* are substantially co-planar and are preferably arranged on a substantially horizontal plane.

The annular body 6 is provided with a plurality of spikes 9 distributed around the axis 10 of the annular body 6 along its entire circumferential extension. The spikes 9, when the two semi-annular portions 6*a*, 6*b* are co-planar, are oriented parallel to the axis 10 of the annular body 6 and are directed with their tip downwardly. Each one of the spikes 9 can engage a loop of knitting of a row of knitting of the manufacture 50 that is arranged proximate to or at the first axial end 50*a* of the manufacture 50 to be closed by sewing or linking. One of the two semi-annular portions 6*a*, 6*b*, constituted in the illustrated case by the semi-annular portion 6*b*, can rotate with respect to the other semi-annular portion about the diametrical axis 7 in order to pass from the co-planar position to an overturned position in which it faces in a downward region the other semi-annular portion 6*a*. In this overturned position, the semi-annular portion 6*b* arranged below has its spikes 9 with the tip directed upwardly and facing a corresponding spike 9 of the semi-annular portion 6*a* that is arranged upwardly. In this position, each spike 9 of the semi-annular portion 6*b* faces and is aligned with a corresponding spike 9 of the other semi-annular portion 6*a*; furthermore, each spike 9 of a semi-annular portion 6*a* or 6*b* is in contact, by means of its tip, with the tip of the corresponding spike 9 of the other semi-annular portion 6*b* or 6*a* so that a loop of knitting carried by a spike 9 of one semi-annular portion can be transferred, by sliding, onto the corresponding spike 9 of the other semi-annular portion.

The handling device 2 is served by a pickup device 11, which has an annular body 12 which supports pickup elements 13, which can engage the needles of the circular machine that produces the manufacture 50 and are adapted to pick up individually the loops of knitting of the manufacture 50 that are retained on the needles of the machine. The pickup device 11 can move on command from a pickup position, in which it is arranged so that its annular body 12 is coaxial around the needle cylinder of the machine, to a release position, in which it is arranged with its annular body 12 at a sewing or linking station 14, which is spaced laterally with respect to the machine for producing the manufacture 50, where the apparatus for performing the method according to the invention is located.

The pickup elements 13 are arranged radially around the axis of the annular body 12 of the pickup device 11 and are mutually angularly spaced around said axis so as to correspond to the angular distance that exists between the needles of the circular hosiery knitting machine. In the illustrated embodiment, the end of each pickup element 13 that is directed toward the axis of the annular body 12 is hook-shaped, with the tip directed upwardly, and can engage a needle of the circular machine, for example in a manner similar to what has been described in patent IT-1.387.067, in order to pick up from the corresponding needle a loop of knitting of the manufacture 50.

The angular spacing of the spikes 9 around the axis 10 of the handling device 2 corresponds to the angular spacing of the pickup elements 13 around the axis of the pickup device 11, so that by arranging the annular body 12 of the pickup device 11 below and coaxially to the annular body 6 of the handling device 2 with the semi-annular portions 6*a*, 6*b* in a co-planar position, each pickup element 13 is arranged at a corresponding spike 9 in a manner that is adapted to allow the passage of a loop of knitting from a pickup element 13 to the corresponding spike 9 of the handling device 2.

The reversing device 3 comprises a lower reversing tube 15, which preferably has a rectilinear extension and can be arranged so that its axis is vertical in a position that is coaxial to the annular body 6 of the handling device 2. The lower reversing tube 15 is supported by a supporting structure 16, which is arranged below the annular body 6 of the handling device 2. The lower reversing tube 15 is inserted coaxially in a guiding and supporting tube 17, which is arranged below the handling device 2 and is connected to the supporting structure 16. More particularly, the supporting and guiding tube 17 is inserted within a lower frame 18, which can be pivoted to the supporting structure 16 about a horizontal axis 19 that is arranged in an intermediate region of the longitudinal extension of the supporting and guiding tube 17 so that it can be inclined laterally, for example by means of the actuation of a linear actuator 20, in order to move the upper end of the supporting and guiding tube 17 closer to the circular hosiery knitting machine that produces the manufacture 50, the axial end 50*a* of which must be closed by sewing or linking, in a manner similar to what is provided for the lower part of the reversing device 3 of patent IT-1.387.067, or so as to move the lower reversing tube 15 so that its axis is vertical and coaxial to the annular body 6 of the handling device 2.

The lower reversing tube 15 can move axially on command with respect to the supporting and guiding tube 17 in order to pass from a lowered position, in which it is arranged coaxially to the annular body 6 of the handling device 2, completely below it, i.e., so that its upper axial end is spaced downwardly from the handling device 2, to a raised position, in which it is arranged so that it axial lower axial end is at the same level as, or at a higher level than, the spikes 9 of the handling device 2, and vice versa.

The lower end of the supporting and guiding tube 17 can be connected on command to suction means or blower means, of the known type and not shown for the sake of simplicity, to perform respectively a suction through the upper axial end of the lower reversing tube 15 or to deliver a jet of air through said end of the lower reversing tube 15.

In the upper end of the lower frame 18 there is a seat 21 that accommodates first axial pusher means 22 constituted by an annular body 23, which is arranged coaxially around the lower reversing tube 15. The annular body 23, in a manner similar to what is described in patent IT-1.387.067, can move with respect to the handling device 2 and the pickup device 11 along the axis of the lower reversing tube 15, which coincides with the axis 10 of the annular body 6 of the handling device 2, in order to actuate the passage of the loops of knitting from the pickup elements 13 of the pickup device 11 to the spikes 9 of the handling device 2.

Conveniently, the handling device 2 comprises means for transferring the loops of knitting supported by the spikes 9 of one semi-annular portion 6*a* to the spikes 9 of the other semi-annular portion 6*b* when they face each other and means for disengaging the manufacture 50 from the spikes 9 of the handling device 2. The transfer means and the means for disengaging the manufacture 50 from the handling device 2 comprise second axial pusher means 24, which are accommodated in the annular body 6 of the handling device 2, above the two semi-annular portions 6*a*, 6*b*, when they are co-planar, and interact with the spikes 9 of the handling device 2 in order to actuate the passage of the loops of knitting from the spikes 9 of one semi-annular portion 6*a* to the spikes 9 of the other semi-annular portion 6*b* when one semi-annular portion 6*b* is overturned below the other semi-annular portion 6*a*, or to disengage the manufacture 50 from the spikes 9 of one semi-annular portion, constituted in the illustrated case by the semi-annular portion 6*b*, after the sewing or linking operation, as will become better apparent hereinafter.

Merely by way of indication, the second axial pusher means can be provided as described in patent IT-1.387.067.

As an alternative, the second axial pusher means 24 can be arranged outside the annular body 6 of the handling device 2 instead of inside.

The annular body 6 of the handling device 2 is connected coaxially around a hollow cylinder 25 which has a vertical axis and is supported, so that it can rotate about its own axis, which coincides with the axis 10, by the supporting structure 16. The semi-annular portion 6*a* is fixed to the outer lateral surface of the hollow cylinder 25, while the semi-annular portion 6*b* is pivoted to the hollow cylinder 25 about the diametrical axis 7.

The hollow cylinder 25 and therefore the annular body 6 of the handling device 2 can rotate about the axis 10 with respect to the supporting structure 16 by way of the action of an electric motor 34, for example in a manner similar to what is described in patent IT-1.387.067.

Conveniently, upper supporting means 26 are provided which can engage the upper axial end of the lower reversing tube 15 so as to retain it in the raised position.

More particularly, above the handling device 2 there is an upper reversing tube 27 which is supported by the same supporting structure 16 or by an autonomous supporting structure.

The upper reversing tube 27 is arranged coaxially above the annular body 6 of the handling device 2 and is provided, in a manner similar to what is described in patent IT-1.387.067, with means for engaging the upper axial end of the lower reversing tube 15, which in its raised position can be inserted, by means of its upper axial end, in the lower axial end of the upper reversing tube 27.

In a manner similar to what is provided in patent IT-1.387.067, the upper reversing tube 27 can be constituted by two sleeves: an upper sleeve 28, which is fixed to the supporting structure 16, and a lower sleeve 29, which can move vertically closer to, or away from, the handling device 2 and can engage the upper axial end of the lower reversing tube 15. The axial mobility of the lower sleeve 29 can be utilized to perform, if required, the additional raising of the lower reversing tube 15 after it has been moved to the raised position and engaged by the lower sleeve 29.

Optionally, the upper reversing tube 27 also can be connected to suction means by way of a connecting tube 37, as will become better apparent hereinafter.

Advantageously, the reversing device 3 comprises auxiliary sliding means 30, which face the outer lateral surface of the lower reversing tube 15 when it is in the raised position. The auxiliary sliding means 30 can move on command with respect to the lower reversing tube 15 parallel to the axis 10 and can engage and disengage cyclically the manufacture 50 that is everted on the outer lateral surface of the lower reversing tube 15 so as to operate its sliding in the direction of the lower axial end of the lower reversing tube 15.

The auxiliary sliding means 30 can be provided and actuated like the auxiliary sliding means 30 described in patent IT-1.387.067 and are not described further for the sake of simplicity.

The lower spacing tube 4 is preferably accommodated inside the supporting and guiding tube 17 and is arranged coaxially to the lower reversing tube 15.

Preferably, the lower spacing tube 4 has a telescopic structure with a length that is variable on command in order to move closer or further apart the upper axial end of the lower spacing tube 4 with respect to the handling device 2.

The upper axial end of the lower spacing tube 4 can be engaged, by means of its upper axial end, with the lower axial end of the lower reversing tube 15, so that the lifting and/or elongation of the lower spacing tube 4 causes the passage of the lower reversing tube 15 from the lowered position to the raised position and so that the lowering and/or shortening of the lower spacing tube 4 allows the retraction of the lower reversing tube 15 into the supporting and guiding tube 17 when the lower reversing tube 15 is disengaged from the upper supporting means 26.

The elongation and shortening, as well as the optional lifting and lowering of the lower spacing tube 4, can be performed by means of mechanical actuators, pneumatic actuators or other actuators of a known type, which are not shown for the sake of simplicity. Merely by way of indication, it is possible to use actuators of the type described in patent IT-1.387.067 to actuate the reversing device 3.

The apparatus for performing the method according to the invention also comprises a sewing or linking head 31 that is arranged proximate to the handling device 2.

The sewing or linking head 31 is provided, in a per se known manner, with sewing elements, which are constituted for example by a needle and by a crochet or by a needle and a thread loader tube or by two needles, so as to provide a sewing or linking chain-stitch. The sewing or linking head 31 is provided furthermore, proximate to the sewing elements, with a horizontal resting element 32 that is designed to support the semi-annular portion 6*b* when it is turned over below the semi-annular portion 6*a* and while it is rotated about the axis 10 together with the hollow cylinder 25.

The sewing or linking head 31 is provided with an electric motor 33 for the actuation of the sewing elements and the actuation of this electric motor 33 is synchronized with the actuation of the electric motor 34 that actuates the annular body 6 of the handling device 2, so that in each instance the needle of the sewing or linking head 31 engages a spike 9 of the semi-annular portion 6*b* that supports a pair of loops of knitting of the manufacture 50, joining them.

The sewing or linking head 31 is provided with a cutter, of a known type and not shown for the sake of simplicity, for cutting the sewing or linking chain-stitch at the end of the sewing or linking operation.

The sewing or linking head 31 is mounted on a slider 35 that is integral with guiding shafts 36, which are oriented so that their axes are horizontal and are supported, so as to be able to slide along their own axes, by the supporting structure 16. A linear actuator, of a known type and not shown for the sake of simplicity, such as for example a fluid-operated cylinder or an electric motor connected to the slider 35 by means of a screw-and-nut connection, acts on the slider 35 and causes the translation on command of the slider 35 and therefore of the sewing or linking head 31 toward the axis 10 of the handling device 2, so as to move the sewing or linking head 31 to a position that is adapted to interact with the spikes 9 of the semi-annular portion 6*b* or away from the axis 10 of the handling device 2, so as to not hinder the arrangement of the pickup device 11 in the sewing or linking station 14 and the overturning of the semi-annular portion 6*b* with respect to the semi-annular portion 6*a* about the diametrical axis 7.

Operation of the apparatus described above in performing the method according to the invention is as follows.

The manufacture, picked up by means of the pickup device 11 from the circular hosiery knitting machine that produced it, is transferred, by the pickup device 11 itself, to the sewing or linking station 14.

The manufacture 50 hangs, with the loops of one of its rows of knitting, preferably with the loops of the last row of knitting formed by the needles of the circular hosiery knitting machine, from the pickup elements 13.

The handling device 2 is arranged so that the two semi-annular portions 6*a*, 6*b* are in a co-planar position, waiting for the manufacture 50.

The lower reversing tube 15 is in the lowered position, i.e., it is spaced with its upper axial end in a downward region with respect to the handling device 2.

When the manufacture 50 is arriving in the sewing or linking station 14, it is aspirated through the upper axial end of the lower reversing tube 15, optionally tilting the lower frame 18 toward the circular hosiery knitting machine, as indicated by the broken lines in FIGS. 1 and 1*a*.

The pickup device 11 is arranged so as to face in a downward region the handling device 2 (FIGS. 1 and 1*a*) and is then raised toward the handling device 2 so that each pickup element 13 engages a spike 9 of the pickup device 11 (FIGS. 2 and 2*a*).

At this point, the annular body 23 of the first axial pusher means 22 is raised toward the pickup device 11 and the handling device 2 so as to cause the passage of each loop of knitting from a pickup element 13 to a spike 9 of the handling device 2 (FIGS. 3 and 3*a*).

In this step of the method, the manufacture 50 is in the right way out configuration, is arranged so that its axis is substantially vertical, and hangs, by means of a first axial end 50*a* thereof to be closed by sewing or linking, from the handling device 2 and is extended below the handling device 2.

With the manufacture 50 in this position, the manufacture 50 is turned inside out by passing it through the annular body 6 of the handling device 2. This passage, since the manufacture 50 hangs with its first axial end 50*a* from the spikes 9 of the handling device 2 and is retained on said spikes 9 by the presence of the pickup device 11, arranges the manufacture 50 in the inside out configuration above the handling device 2.

Conveniently, if, as preferred, the manufacture is aspirated inside the lower reversing tube 15, the reversing of the manufacture 50 is performed by lifting the lower reversing tube 15 and making it pass through the annular body 6 of the handling device 2. This lifting of the lower reversing tube 15 causes the eversion of the manufacture 50 onto the outer lateral surface of said lower reversing tube 15 (FIGS. 4 and 4*a*).

The passage of the lower reversing tube 15 from the lowered position to the raised position is performed by extending axially and optionally lifting the lower spacing tube 4, which, as mentioned, preferably has a telescopic structure.

Optionally, in order to complete the reversing of the manufacture 50 and its eversion onto the outer lateral surface of the lower reversing tube 15, the auxiliary sliding means 30 are used and, by engaging and disengaging cyclically the manufacture 50, push it progressively toward the lower axial end of the lower reversing tube 15, extracting it completely from the upper axial end of the lower reversing tube 15 and thus freeing said upper axial end of the lower reversing tube 15 (FIGS. 5 and 5*a*).

Optionally, during the reversing of the manufacture 50, the lower axial end of the lower spacing tube 4 can be connected to blower means to push upwardly the manufacture 50 while it is inside the lower reversing tube 15, assisting the action of the auxiliary sliding means 30.

At this point, the lower sleeve 29 of the upper reversing tube 27 is lowered and engages the upper axial end of the lower reversing tube 15 (FIGS. 6 and 6*a*).

The lower spacing tube 4 is then lowered into a position in which its upper axial end is spaced downwardly from the handling device 2 and the pickup device 11 is moved away from the sewing station 14 (FIGS. 7 and 7*a*).

With the manufacture 50 in this position, the semi-annular portion 6*b* of the annular body 6 of the handling device 2 is turned over about the diametrical axis 7 and is arranged so as to face in a downward region the other semi-annular portion 6*a* so that the spikes 9 of the semi-annular portion 6*b* face and are aligned with the spikes 9 of the other semi-annular portion 6*a*. By way of the actuation of the second axial pusher means 24, the loops of knitting carried by the spikes 9 of the semi-annular portion 6*a* that is arranged above are transferred to the spikes 9 of the semi-annular portion 6*b* that is arranged below. In this manner, each spike 9 of the semi-annular portion 6*b* that is arranged below carries two loops of knitting.

The sewing or linking head 31 is then moved toward the handling device 2 and its sewing elements are actuated in a manner that is synchronized with the rotation of the annular body 6 of the handling device 2, so as to progressively sew or link the loops of knitting carried by the spikes 9. In this manner, the first axial end 50*a* of the manufacture 50 that is engaged with the handling device 2 is closed (FIGS. 8 and 8*a*).

Once the sewing or linking operation has ended, the sewing or linking head 31 is again moved away laterally from the handling device 2, the semi-annular portion 6*b* is returned to the position in which it is co-planar to the other semi-annular portion 6*a*, and the lower spacing tube 4 is raised so as to move closer, with its upper axial end, to the handling device 2. The lower spacing tube 4 is connected to suction means and, by means of a new actuation of the second axial pusher means 24, the manufacture 50 is disengaged from the spikes 9 (FIGS. 9 and 9*a*). By way of the suction applied to the lower spacing tube 4, the manufacture 50 is drawn into the lower spacing tube 4 and unloaded outside the apparatus in the inside out configuration (FIGS. 10 and 10*a*). The suction of the manufacture 50 inside the lower spacing tube 4 can be facilitated by the actuation of the auxiliary sliding means 30, which push the manufacture 50 onto the outer lateral surface of the lower reversing tube 15 downwardly, i.e., toward the lower spacing tube 4.

It should be noted that although preferably the manufacture 50 is picked up from the production machine and transferred to the spikes 9 of the handling device 2 with a loop of knitting for each spike 9, the pickup and transfer can be performed also with other methods, such as for example a method that provides for gripping the manufacture 50 also at a row of knitting that is not the last row of knitting formed and with a plurality of loops of knitting for each pickup element 13 and for each spike 9.

Moreover, it should be noted that the apparatus for performing the method according to the invention can, if required, perform the unloading of the manufacture 50, after the operation for closing its first axial end 50*a*, also in the right way out configuration. In fact, to achieve this it is sufficient to keep the lower spacing tube 4 inactive in the lowered position and connect the upper reversing tube 27, through the connecting duct 37, to suction means. In this manner, when the first axial end 50*a* of the manufacture 50 is disengaged from the spikes 9, the manufacture 50 is drawn into the upper reversing tube 27 through the lower axial end thereof and thus returned to the right way out configuration. The manufacture 50 is then moved away from the apparatus and unloaded externally through the connecting duct 37.

In practice it has been found that the method according to the invention achieves fully the intended aim, since it allows to perform the automated closure of an axial end of a tubular manufacture, for example a hosiery item, and to unload the manufacture in the inside out configuration so as to make it available for finishing operations in this configuration.

It is important to note that although the manufacture is unloaded in the inside out configuration, the closure of an axial end thereof by sewing or linking is performed with the manufacture in the inside out configuration, making the linking chain-stitch or the sewing stitches practically invisible on the right side of the manufacture and therefore with a fully satisfactory result from an aesthetic standpoint.

A further advantage of the method according to the invention is that it can be performed with an apparatus that can be derived, with modifications that are simple to provide, from apparatuses that are already available, such as for example the apparatus described in patent IT-1.387.067.

The method and the apparatus for its execution thus conceived are susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2013A000296 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

What is claimed is:

1. A method for closing an axial end of a tubular manufacture and for unloading it inside out, comprising in sequence:

a step of positioning the manufacture right way out at a sewing or linking station, arranged so that its axis is substantially vertical and so that it hangs, by means of a first axial end to be closed by sewing or linking, from an annular handling device, said manufacture being extended below said annular handling device;

a step of turning the manufacture inside out, in which the manufacture, retained by said annular handling device, is passed through said annular handling device, said passage arranging the manufacture inside out above said annular handling device, said step of turning the manufacture inside out being provided by performing in sequence the following actions:

aspirating beforehand the manufacture, which hangs with said first axial end from said annular handling device, in a lower reversing tube that faces, with its upper axial end, below said annular handling device;

lifting said lower reversing tube, making it pass, starting from its upper axial end, through said annular handling device until said lower reversing tube is brought to a raised position, in which its lower axial end is at the same level or at a higher level than said first axial end of the manufacture engaged with said annular handling device, performing the at least partial reversion of the manufacture onto the outer lateral surface of said lower reversing tube;

retaining said lower reversing tube in said raised position;

a step of closing said first axial end of the manufacture by sewing or linking;

a step of disengaging the manufacture from said annular handling device;

a step of moving the manufacture away by means of suction through the upper axial end of a lower spacing tube that faces, with its upper axial end, below said annular handling device.

2. The method according to claim 1, wherein said reversing step comprises a step of sliding the manufacture on the outer lateral surface of said lower reversing tube in said raised position from the upper axial end to the lower axial end of said lower reversing tube, completing the eversion of the manufacture on the outer lateral surface of said lower reversing tube and releasing from the manufacture the upper axial end of said lower reversing tube.

3. The method according to claim 2, wherein said lower reversing tube is retained in said raised position by engaging its upper axial end that is free from the manufacture.

4. The method according to claim 1, wherein during said spacing step the manufacture is made to slide on the outer lateral surface of said lower reversing tube toward the lower axial end of said lower reversing tube in order to assist the suction effect on the manufacture applied by said lower spacing tube.

5. An apparatus for performing the method according to claim 1, comprising:

an annular handling device that can engage a first axial end of the manufacture to be closed by sewing or linking;

a reversing device adapted to bring the manufacture, which hangs with said first axial end from said annular handling device, to the inside out configuration above said annular handling device;

a lower spacing tube that faces, with its upper axial end, below said annular handling device;

means for sewing or linking said first axial end of the manufacture that can be operated to close said first axial end of the manufacture that is engaged with said annular handling device and is arranged inside out above said annular handling device;

said annular handling device being disengageable on command from the manufacture and said lower spacing tube being connectable to suction means in order to aspirate the manufacture through its upper axial end and to move the manufacture away upon its disengagement from said annular handling device.

6. The apparatus according to claim 5, wherein said lower spacing tube has a telescopic structure with a length that can vary on command in order to move closer or further away the upper axial end of said lower spacing tube with respect to said annular handling device.

7. The apparatus according to claim 5, wherein said device for reversing the manufacture comprises a lower reversing tube that is supported by a supporting structure below said annular handling device, said lower reversing tube being connectable to suction means and/or to means for supplying compressed air.

8. The apparatus according to claim 7, wherein said lower reversing tube is arranged coaxially to said annular body of the annular handling device.

9. The apparatus according to claim 7, wherein said annular body of the annular handling device is composed of two semi-annular portions that are mutually pivoted about a diametrical axis; one semi-annular portion of said two semi-annular portions being able to rotate with respect to the other semi-annular portion about said diametrical axis in order to pass from a position that is co-planar to the other semi-annular portion to a position that faces the other semi-annular portion; said annular body supporting a plurality of spikes that are distributed along the circumferential extension of said annular body and are arranged, with said two semi-annular portions in a co-planar position, so that their axis is vertical and so that their tip is directed downwardly; each one of said spikes being engageable with a loop of knitting of a row of knitting proximate to or at said first axial end of the manufacture; said annular body being arranged coaxially to said upper reversing tube and to said lower reversing tube; the spikes of one semi-annular portion, in the position that faces the other semi-annular portion, facing and being aligned with the spikes of the other semi-annular portion; means for transferring the loops of knitting arranged on the spikes of one semi-annular portion to the spikes of the other semi-annular portion and means for disengaging the loops of knitting from said spikes being provided.

10. The apparatus according to claim 7, wherein said lower reversing tube can move on command along its own axis in order to pass from a lowered position, in which it is arranged so that its upper axial end lies below said annular handling device, to a raised position, in which it is arranged with its lower axial end at the same level as, or at a higher level than, the region of said annular handling device that can engage said first axial end of the manufacture by passing through said annular handling device, and vice versa.

11. The apparatus according to claim 10, further comprising upper supporting means that can engage the upper axial end of said lower reversing tube to retain it in said raised position.

12. The apparatus according to claim 10, further comprising auxiliary sliding means that face an outer lateral surface of said lower reversing tube in said raised position and can move on command with respect to said lower reversing tube parallel to its axis; said auxiliary sliding means being cyclically engageable and disengageable with the manufacture that is everted onto the outer lateral surface of said lower reversing tube in order to make it slide toward the lower axial end of said lower reversing tube.

13. The apparatus according to claim 10, wherein said lower spacing tube can engage, by its upper axial end, the lower axial end of said lower reversing tube to provide the passage of said lower reversing tube from said lowered position to said raised position.

14. The apparatus according to claim 7, wherein said lower spacing tube and said lower reversing tube are arranged so that their axes are vertical and are substantially coaxial.

15. A method for closing an axial end of a tubular manufacture and for unloading it inside out, comprising in sequence:

a step of positioning the manufacture right away out at a sewing or liking station, arranged so that its axis is substantially vertical and so that it hangs, by means of a first axial end to be closed by sewing or linking, from an annular handling device, said manufacture being extended below said handling device;

a step of turning the manufacture inside out, in which the manufacture, retained by said annular handling device, is passed through said annular handling device, said passage arranging the manufacture inside out above said annular handling device;

a step of closing said first axial end of the manufacture by sewing or linking;

a step disengaging the manufacture from said annular handling device;

a step of moving the manufacture away by means of suction through the upper axial end of a lower spacing tube that faces, with its upper axial end, below said annular handling device;

said annular handling device being capable of engaging a first axial end of the manufacture to be closed by sewing or linking;

a reversing device adapted to bring the manufacture, which hangs with said first axial end from said annular handling device, to the inside out configuration above said annular handling device;

a lower spacing tube that faces, with its upper axial end, below said annular handling device;

a device for sewing or linking said first axial end of the manufacture that can be operated to close said first axial end of manufacture that is engaged with said annular handling device and is arranged inside out above said annular handling device;

said annular handling device being disengageable on command from the manufacture and said lower spacing tube being connectable to suction means in order to aspirate the manufacture through its upper axial end and to move the manufacture away upon its disengagement from said annular handling device.

* * * * *